US007360327B2

(12) United States Patent
Osgood et al.

(10) Patent No.: US 7,360,327 B2
(45) Date of Patent: Apr. 22, 2008

(54) MATERIAL MOVING PUSHER/BUCKET

(75) Inventors: Kevin R. Osgood, Reading, VT (US); James H. Davis, Claremont, NH (US); David J. Smith, Sr., Charlestown, NH (US)

(73) Assignee: Ralph L. Osgood, Inc., Claremont, NH (US)

( * ) Notice: Subject to any disclaimer, the term of this patent is extended or adjusted under 35 U.S.C. 154(b) by 512 days.

(21) Appl. No.: 10/843,955

(22) Filed: May 12, 2004

(65) Prior Publication Data

US 2005/0193602 A1 Sep. 8, 2005

Related U.S. Application Data

(60) Provisional application No. 60/543,959, filed on Feb. 12, 2004.

(51) Int. Cl.
*E02F 3/32* (2006.01)

(52) U.S. Cl. ..... 37/444; 37/445; 37/274; 172/784

(58) Field of Classification Search ..... 37/443, 37/44, 445, 281, 274, 442, 398; 172/784, 172/815; 414/480
See application file for complete search history.

(56) References Cited

U.S. PATENT DOCUMENTS

| | | | | | |
|---|---|---|---|---|---|
| 735,257 | A * | 8/1903 | Hodgins | 37/398 |
| 987,612 | A * | 3/1911 | Butler | 37/398 |
| 2,556,592 | A | 6/1951 | Markkula | 214/140 |
| 2,841,897 | A * | 7/1958 | Duke | 172/815 |
| 3,166,339 | A * | 1/1965 | Earley | 280/654 |
| 3,424,251 | A * | 1/1969 | Bouley | 172/810 |
| 3,760,883 | A | 9/1973 | Birk | 172/273 |
| 4,089,431 | A * | 5/1978 | Stedman | 414/726 |
| 4,306,362 | A * | 12/1981 | Waterman | 37/219 |
| 4,356,645 | A | 11/1982 | Hine et al. | 37/281 |
| 4,723,609 | A | 2/1988 | Curtis | 172/815 |
| 4,779,363 | A * | 10/1988 | Boutrais et al. | 37/405 |
| 5,088,882 | A | 2/1992 | Lovitt, Jr. | 414/723 |
| 5,148,617 | A | 9/1992 | Feller et al. | 37/281 |
| 5,241,763 | A * | 9/1993 | Dynan | 37/407 |
| 5,819,444 | A | 10/1998 | Desmarais | 37/281 |
| 6,154,986 | A | 12/2000 | Hadler et al. | 37/234 |
| 6,240,660 | B1 * | 6/2001 | Dugas | 37/280 |
| 6,425,196 | B1 | 7/2002 | Weagley et al. | 37/270 |
| 6,470,604 | B1 * | 10/2002 | Foster et al. | 37/267 |
| 6,574,890 | B2 | 6/2003 | Bateman, Jr. | 37/264 |
| 2004/0140110 | A1 * | 7/2004 | Raup | 172/817 |

* cited by examiner

*Primary Examiner*—Thomas A Beach
(74) *Attorney, Agent, or Firm*—Michael J. Weins; Jeffrey E. Semprebon

(57) ABSTRACT

A pusher/bucket has back plate with wings pivotably mounted at either end, and a drop blade pivotably mounted thereto. The drop blade can be secured in a raised position where it is superimposed over the back plate; when in the raised position, the wings can be positioned relative to the back plate to provide a wing plow. The wings can be folded parallel to the back plate, with the raised drop blade residing therebetween. When the wings are normal to the back plate, the drop blade can be secured in a lowered, horizontal position; in this position, the drop blade acts as the bottom of a loading bucket, the sides being formed by the wings and the back plate. A float mechanism allows the pusher/bucket to push material across uneven terrain, and is preferably disabled when the pusher/bucket is configured as a bucket for loading and dumping material.

20 Claims, 14 Drawing Sheets

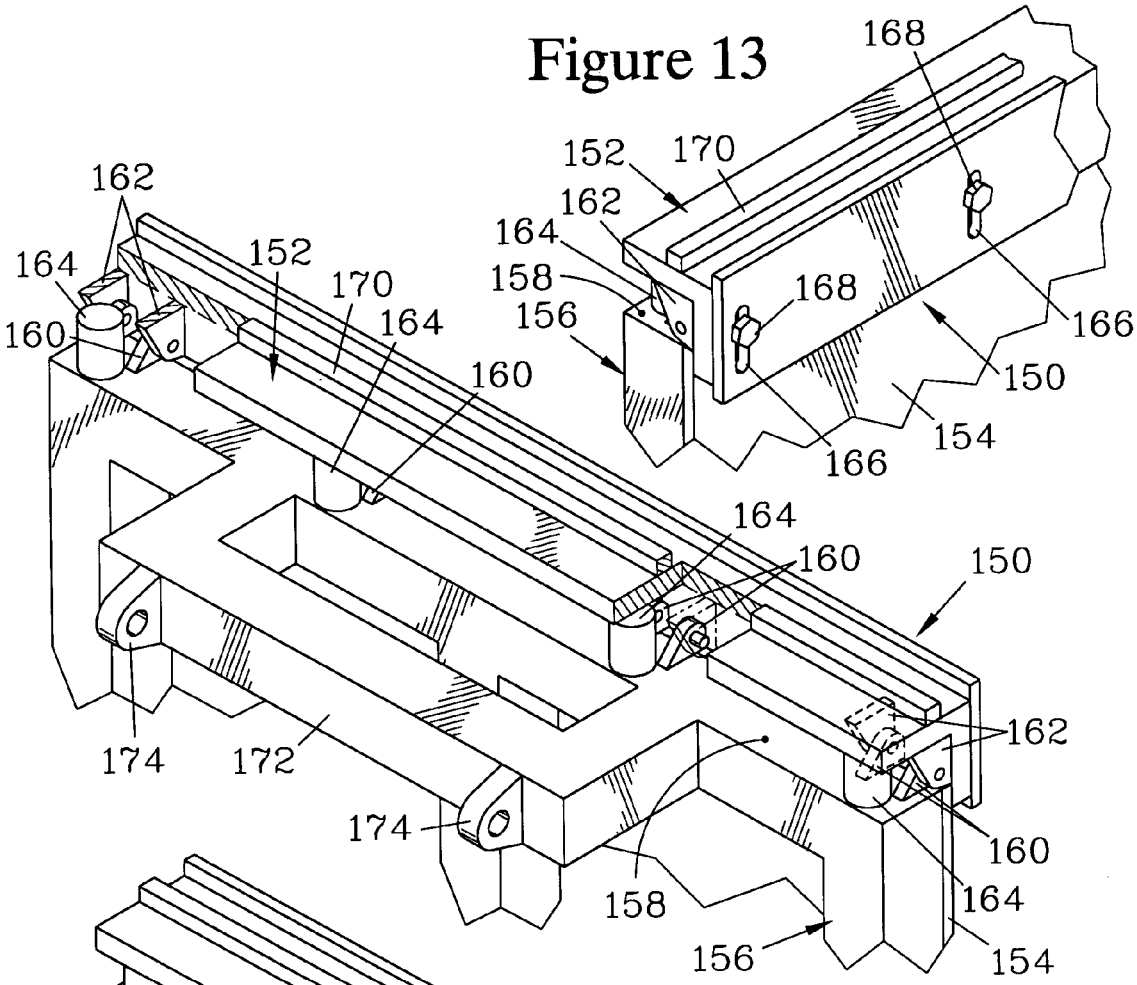
Figure 13
Figure 14
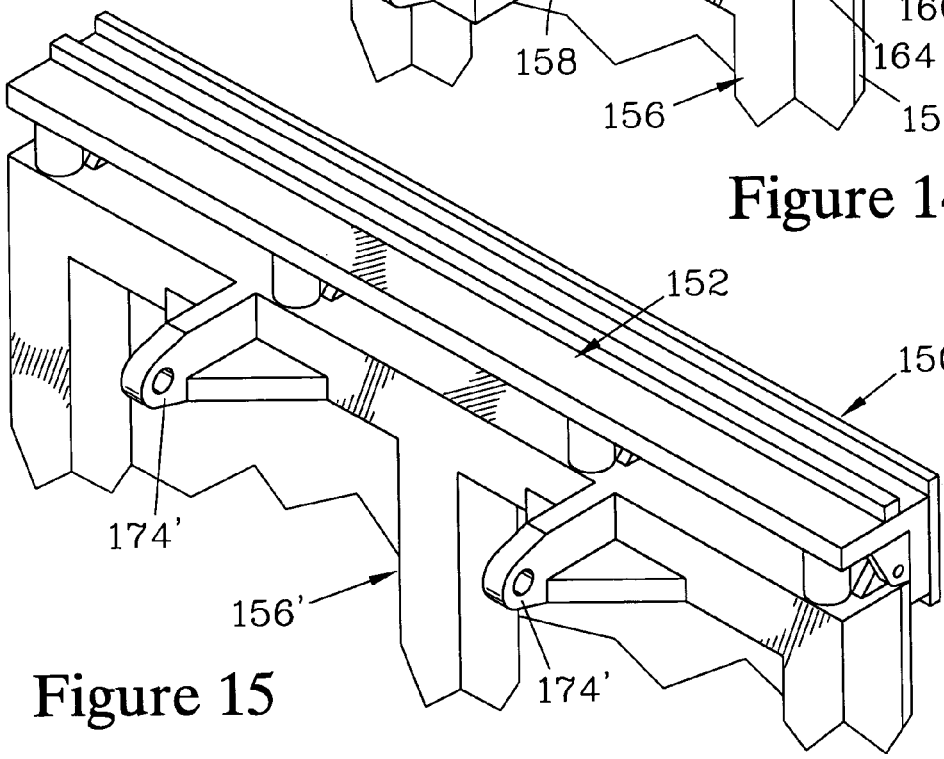
Figure 15

MATERIAL MOVING PUSHER/BUCKET

FIELD OF THE INVENTION

The present invention relates to devices for removing material from ground surfaces, and more particularly for a device which can be configured to push material as well as configured to load and dump material.

BACKGROUND OF THE INVENTION

To remove material from large areas, it is desirable to have a large pushing structure to allow the structure to clear a wider swath across the surface. A typical application is the removal of snow from a paved area such as a road, runway, or parking lot. Conventional snow plows, having a wide blade for pushing the snow aside, have classically been used.

More recently, wider structures called "pushers" have been employed. In addition to having a wider blade, pushers include side boards which frequently extend forward on either side of the blade to direct the material forward and reduce spillage to the sides. Pushers are typically mounted to a bucket loader vehicle, either attached to the conventional bucket or in place thereof. Due to their large size, pushers may need to be removed from the loader vehicle for transport between work sites. One approach to overcome this deficiency is to make the pusher structure foldable for storage and transport, as taught in U.S. Pat. No. 6,425,196.

A more versatile approach to provide a wider swatch of material removal than is available with a conventional snow plow is to use a "wing plow". Wing plows have a central main blade with a wing pivotably mounted to each side. The wings can typically be locked in one of three positions. In one position, the wings extend forward and angled outwards from the main blade, providing a wider combined surface for pushing material, while also providing some of the directional effect of a conventional pusher. The wings can also be locked at a position extending forward at 90° to the main blade, where they serve the same function as the side boards of a pusher to provide improved directing of the material. The wings can also be folded in to a position where they are superimposed on the main blade, so as to serve as a narrow plow. The ability to adjust the width of the pushing surface and its directional characteristics makes wing plows especially well suited for applications where material must be removed from both wide open areas and relatively narrow spaces. Additionally, when the wings are folded in, the structure is compact for greater ease of storage or transportation. Like pushers, wing plows are typically mounted to a loader vehicle, either in place of the conventional loader bucket or by being attached thereto.

As noted above, when pushers and wing plows are mounted to a loader vehicle, the pushing structure is either mounted to the bucket or mounted to the loader vehicle in place of the bucket. In either case, the bucket of the loader is unavailable for use when the pushing structure is mounted. There are frequently situations where the material, after being pushed across the surface to a desired location, must then be loaded into a vehicle for transportation. With existing pushers and wing plows, either a second loader vehicle must be employed, or the pushing structure must be inconveniently removed to use the loading vehicle with its bucket. In either case, a large amount of operator time is required to complete the moving and loading operations. This shortcoming has been partially addressed by U.S. Pat. No. 4,723,609, which teaches conversion of a wing plow-like scraper to a bucket loader by providing a bottom pan to be installed by the operator when the wings of the scraper are at right angles. This still requires considerable effort on the part of the operator, and furthermore requires an additional place to store the bottom pan when it is not in use.

An alternative approach has been to flair out the end of a bucket to widen the sweep, as is taught in U.S. Pat. No. 6,574,890. However, this results in a blade having a fixed width, which generates problems which the wing plow was designed to cure. Furthermore, if the device is to be effective in distributing the material when the material is pushed to the side, the depth of the bucket should be relatively shallow, which will limit the capacity for loading material when the device is used as a bucket. The broad opening of such a bucket also limits the control of the dumping of the contents, and may not allow the contents to be dumped into a small target, such as the bed of a dump truck.

To allow pushers and wing plows to move material across surfaces that are uneven, the pushing structure must incorporate some degree of flexibility. U.S. Pat. Nos. 5,148,617 and 6,154,986 teach structures for mounting an articulated plow to a vehicle while allowing a limited degree of floating of the plow to accommodate uneven surfaces. The float structure appears to be designed to allow the main blade to tilt a few degrees forward or backwards by pivoting, so as to accommodate undulation in the paved surface as the plow advances; however, the degree of motion appears to be limited to such slight tilting of the blade.

Thus, there is a need for a pushing structure that provides the benefits of a pusher and/or wing plow as well as providing greater ease and efficiency in loading of material, as well as for a mounting structure which allows such a pushing structure to be employed effectively on uneven surfaces.

SUMMARY OF INVENTION

The present invention is for a device which is mounted to a vehicle to provide a pusher/bucket material handler which has utility for a variety of applications; one application for which the device has particular utility is snow removal. In this application, the device can be configured as a pusher or plow for movement of snow and then reconfigured into a bucket for removal of the snow from the site or for loading into a bed of a transport vehicle without the need to change vehicles or to change the attachment mounted on a single vehicle. This ability to be configured for multiple functions is of particular benefit for applications when the equipment is large and needs to be transported to and from the work site. It can also result in savings for the purchaser, since only one piece of equipment need be purchased.

The pusher/bucket of the present invention has a back assembly with a back plate that is nominally vertical and terminates in an upper edge and two vertical edges. The back assembly also has a back scraping plate terminating in a back scraping edge opposite the upper edge of the back plate. Preferably, the back scraping edge is provided on a shoe that is shock mounted with respect to the back plate and has a replaceable and adjustable scraping blade mounted thereto. The shock mounting provides flexibility for the shoe to help the scraping blade make adjustments to accommodate discontinuities in the surface. It is preferred for the back assembly to be provided with a back frame to stiffen and support the back plate.

A first wing is pivotally mounted with respect to the back plate. The first wing is positionable between a position substantially parallel to and at a separation D from the back plate, and at least one position that is substantially normal to the back plate. A second wing is spaced apart from the first wing and is also pivotally mounted with respect to the back plate, being positionable between a position substantially parallel to and at a separation D from the back plate and at least one position that is substantially normal to the back plate. The wings are provided with wing scraping edges which are replaceable, and preferably fabricated from a resilient material that allows the wing scraping edges to accommodate discontinuities in the surface.

It is preferred for at least one of the wings, and more preferably both of the wings, to be movable to and affixable in one or more additional positions where the included angle between the wing and the back plate is an obtuse angle, to increase the versatility of the pusher/bucket. Preferably, the wings are pivotally mounted in close proximity to the vertical edges of the back plate to maximize their separation when positioned normal to the back plate.

A drop blade is provided, which has a cutting edge that preferably terminates a substantially planar lead region. The drop blade is mounted so as to pivot about a drop blade axis between a raised position and a lowered position. In the lowered position, the cutting edge is substantially in a plane defined by the wing scraping edges. When the drop blade has a substantially planar lead region, it is preferred for the substantially planar lead region of the drop blade to extend substantially normal to the back plate when the drop blade is in its lowered position. In the raised position, the drop blade is superimposed over the back plate. When in such position, the drop blade has a maximum separation S from the back plate such that $S \leqq D$.

Means for locking the first wing and the second wing in designated positions are provided. The means can be incorporated in hinges that are employed to pivotally mount the wings with respect to the back plate. Alternatively, means for locking the wings in designated positions can be provided by powered actuators such as hydraulic cylinders. These actuators are pivotally attached with respect to the back plate and the wings.

One preferred hinge configuration, which is designed to be employed with a back assembly which employs the back frame for stiffening and supporting the back plate, is a hinge that has a pair of spaced-apart wing brackets attached to the back frame for mounting each of the wings. The wing brackets, while mounted to the back frame, extend forward beyond the back plate to provide a mount for the wing about a pivot axis that is forward of the back plate. The wing brackets engage wing tabs that are attached to the wing and are configured to pivotally engage the wing brackets. Wing pivot pins are positioned such that the wing, when positioned substantially parallel to the back plate, is maintained at the separation D therefrom.

When spaced-apart wing brackets which protrude in front of the back plate are employed to mount the wings, it is preferred to provide blocking plates interposed between the wing brackets to close the open spaces on either side between the wing brackets, the wing, and the back plate, through which material could pass as the device moves forward with the wings extended, such as to provide a bucket or a wing plow; for the purpose of this discussion, a wing plow is defined as a configuration of the wings such that the included angle between at least one of the wings and back plate is an obtuse angle. The blocking plates can be affixed with respect to either the back plate or the wings. However, it is preferred to have the blocking plates affixed with respect to the back plate to avoid overhang when the wings are positioned parallel to the back plate; additionally, when the blocking plates are so positioned, they can be configured so as to provide reinforcement for the wing brackets.

When the hinges employ wing brackets that engage wing tabs, the means for locking the wings in designated positions can be provided by a combination of bracket stop surfaces and tab stop surfaces which limit the range of the pivotal motion of the wings, wing positioning pins which pass through bracket indexing passages and engage either tab indexing passages or tab stop surfaces, and/or contact of the wings with the drop blade.

Similarly, there are means for locking the drop blade in the lowered position and in the raised position, which can be provided by powered actuators that are pivotally connected with respect to the back plate and the drop blade. Alternatively, the means for locking the drop blade in the raised position and in the lowered position can be provided by connecting elements associated with the drop blade and the back frame and/or the wings.

One preferred combination of connecting elements that can be employed to lock the drop blade in its lowered position includes a wing tongue extending from a wing inner surface of each of the wings (the wing inner surface being defined as the surface which defines the separation D), and drop blade brackets on the drop blade, each having a tongue slot configured to accept one of the wing tongues.

The wing tongues are preferably provided with tongue passages therethrough that are positioned such that, when the wing tongue is fully engaged with the tongue slot of the corresponding drop blade bracket, the drop blade bracket resides between the tongue passage and the wing inner surface. A tongue pin can then be inserted into the tongue passage to provide a means for preventing any spreading of the wings from the drop blade as material is loaded into the bucket formed by the wings, the drop blade and the back plate. Thus, the combination of the drop blade brackets, the wing tongues, and the tongue pins could serve as means for maintaining the wings in a bucket-forming configuration; however, it is preferred that they be employed to complement wing positioning pins or actuators such as are discussed above.

When drop blade brackets are employed, they can also serve to form part of the means for locking the drop blade in the raised position. When the drop blade brackets are so employed, the back plate is provided with plate slots positioned to accept the drop blade brackets when the drop blade is in the raised position. To employ the drop blade brackets as part of the locking means, the wing tongues are positioned on the wings such that the tongue slots of the drop blade brackets are correspondingly positioned such that, when the drop blade is in the raised position, the tongue slots reside behind the back plate. This allows one or more blade retaining pins to be inserted into the tongue slots to maintain the drop blade in the raised position.

Another feature of the pusher/bucket device of the present invention is a float mechanism which has utility for the present device, as well as for other pushers, plows, and other tools that are attachable to an instant transfer connector, such as the Caterpillar IT connector. This float mechanism allows the pusher/bucket to compensate for irregularities in the height and the side grade of the terrain over which the pusher/bucket passes. It allows the device to rise when a ridge is encountered and compensate for irregularities that are not readily accommodated by a shock-mounted shoe. Preferably, the float mechanism also allows the back assembly of the device to pitch side to side to accommodate variation in the side grade of the surface.

The float mechanism has a pair of substantially vertical supports attached to a spacing member of sufficient length to assure that the substantially vertical supports are properly separated to slidably engage the transfer connector. The substantially vertical supports have rear surfaces configured so as to be lockable with the transfer connector when slidably engaged therewith. The substantially vertical supports have upper sections, each having a substantially vertical slot. The substantially vertical slots are both vertically aligned, and are configured to slidably engage a transfer bar, which in turn is affixed with respect to the frame of the device (for the pusher/bucket described above, the back frame is considered the frame). The transfer bar preferably has a pair of spaced apart sides for engaging the substantially vertical slots.

Means for stabilizing the motion of the transfer bar in the slots is provided which limits both pitching and longitudinal movement of the transfer bar with respect to the vertical slots. This structure of the float mechanism of the present invention allows adjustment in the elevation of the pusher/bucket without a change in the vertical inclination of the back frame and the wings. One preferred means for stabilizing is a pair of links that are pivotably attached both to a lower region of each of the pair of substantially vertical supports and to the frame of the plow or bucket. The links restrict lateral motion of the transfer bar relative to the vertical slots. The links are so positioned and connected as to prevent pitching of the frame either forward or backward, to avoid binding between the slots and the rectangular transfer bar which might immobilize the frame.

When the float mechanism is employed to mount a pusher/bucket such as described above, which can be configured either to push material or to load and dump material, it is preferred to provide means for disabling the float mechanism. Such means block the vertical motion of the transfer bar in the vertical slots to avoid banging of the elements during dumping operations.

BRIEF DESCRIPTION OF THE FIGURES

FIG. 1 also illustrates a back scraping blade attached to the back frame. The wings have pieces of a resilient material attached to them to serve as wing scraping blades.

FIG. 6 also illustrates the wings when they are in an extended position, as well as the structure for maintaining the drop blade in its raised position. The drop blade is retained in its raised position by plate slots in the back plate, through which the drop blade brackets partially pass, in combination with a blade retaining pin that slidably engages one of the drop blade brackets to maintain it in the plate slot.

FIG. 10 illustrates the wing tab when the wing has been folded inward so as to be superimposed on the back plate (the position shown in FIG. 4). It is blocked from further movement toward the back plate by engagement with the drop blade. A wing position pin passes through a second bracket positioning passage of the wing bracket, and a first tab stop surface on the wing tab engages the wing position pin to prevent the wing from pivoting away from the back plate. FIG. 11 illustrates the wing when it is positioned normal to the back plate (the position shown in FIGS. 2 and 3). The wing position pin passes through a first bracket positioning passage of the wing bracket and through a tab indexing passage in the wing tab to prevent the wing from pivoting. FIG. 12 illustrates the wing when it is in an extended position, and extends forward and outward from the back plate (the position shown in FIG. 6). In the extended position illustrated, a second bearing surface on the wing tab engages a bracket bearing surface on the corresponding wing bracket. Each of the wings is maintained in the extended position by the wing position pin passing through the first positioning passage in the wing bracket, where the wing position pin bears against a third bearing surface on the wing tab to prevent pivoting.

FIG. 13 is a partial front isometric view of the lower region of a back plate such as that shown in FIG. 1, illustrating a shoe for mounting an adjustable back scraping blade so as to flexibly couple the back scraping blade to the back plate.

FIG. 14 is a rear isometric view of the shoe illustrated in FIG. 13, showing its attachment to a support frame having features in common with the frame shown in FIG. 6.

FIG. 15 is the same shoe as shown in FIGS. 13 and 14; however, it is attached to a different support frame.

FIG. 16 shows the wings when positioned normal to the back plate. In this embodiment, blocking plates that extend between the wing brackets are formed integrally with the wings, rather than being affixed to the back assembly. FIG. 16 also illustrates wing support blocks which can be placed on each of the wings to provide additional support of the wings when they reside against the raised drop blade.

FIG. 25 shows the wing when in its folded position, where it is parallel to the back plate. The wing is maintained in this position by a wing positioning pin which passes through the bracket positioning passage and through a first wing tab passage. FIG. 26 illustrates the wing extending normally to the back plate; the wing is maintained in this position by the wing positioning pin passing through the bracket positioning passage and through a second wing tab passage. FIG. 27 illustrates the wing extending forwards and outwards. The wing is maintained in its extended position by engagement between a bracket stop surface and a wing tab stop surface, as well as by the wing positioning pin passing through the bracket positioning passage and through a third wing tab passage.

DETAILED DESCRIPTION OF THE PREFERRED EMBODIMENTS

Figure 1:
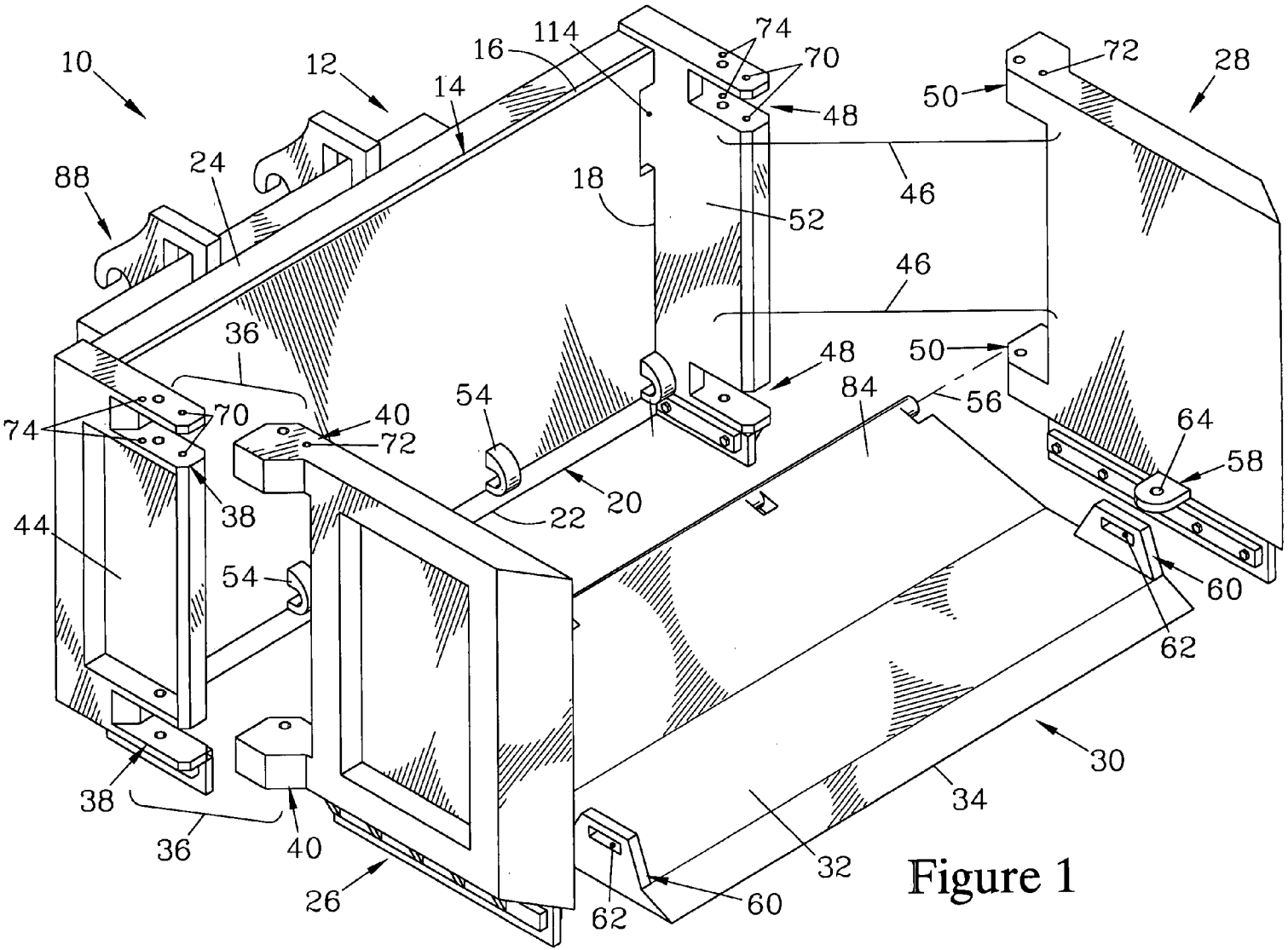
FIG. 1 is an exploded isometric view illustrating the main elements of one embodiment of the present invention, a pusher/bucket which can be configured to serve as a conventional wing plow or as a loading bucket. The pusher/bucket has a back frame attached to a mounting structure to allow it to be mounted to a vehicle. The back frame has a back plate attached thereto which is substantially vertical when the pusher/bucket is in use. Also attached to the back frame are two pairs of wing brackets, both pairs of brackets extending in front of the back plate and substantially normal thereto. A first wing and a second wing are pivotably mounted to the wing brackets by wing tabs. The wing brackets and wing tabs form hinges that allow the first and second wings to move between a folded position, a normal position, and an extended position. Blocking plates are positioned between the bracket pairs to reduce the size of open regions between the back plate and the wings, and in this embodiment are attached to the wing brackets. The pusher/bucket also has a drop blade that is pivotably attached with respect to the back plate so as to pivot between a raised position and a lowered position.

FIGS. 1 through 6 are various views of a pusher/bucket 10 that forms one embodiment of the present invention. FIG. 1 is a partially exploded isometric view looking from the front toward a back assembly 12 of the pusher/bucket 10. The back assembly 12 has a back plate 14 that terminates in an upper edge 16 and two vertical edges 18 (only one of which is shown), and has a back scraping blade 20 which terminates in a back scraping edge 22 resiliently attached with respect to the back plate 14. The back plate 14 in turn is mounted on a back frame 24 to provide rigidity to the back plate 14 without unduly increasing the overall weight of the pusher/bucket 10.

The pusher/bucket 10 also has a first wing 26, a second wing 28, and a drop blade 30 that has a substantially planar lead region 32 terminating in a beveled cutting edge 34.

A first pair of hinges 36 is employed to provide pivotal motion between the back plate 14 and the first wing 26. Each of the hinges 36 in turn has a first wing bracket 38 attached to the back frame 24 and a first wing tab 40 attached to the first wing 26. Each of the first wing tabs 40 engages one of the first wing brackets 38 and is connected thereto by a pivot pin 42 (shown in FIG. 2) to provide pivotal motion between the first wing 26 and the back plate 14. The region between the pair of first wing brackets 38 is covered by a first blocking plate 44. Similarly, a second pair of hinges 46 is provided, which has a pair of second wing brackets 48, again attached to the back frame 24, and a pair of second wing tabs 50, attached to the second wing 28 and pivotably connected to the pair of second wing brackets 48 by pivot pins 42. The region between the pair of second wing brackets 48 is covered by a second blocking plate 52. In this embodiment, the blocking plates (44 and 52) are integral with their associated pair of wing brackets (38 and 48) and provide structural reinforcement of the wing brackets (38 and 48). Multiple drop blade mount brackets 54 are provided to pivotally mount the drop blade 30 with respect to the back plate 14 about a drop blade pivot axis 56.

Figure 2:
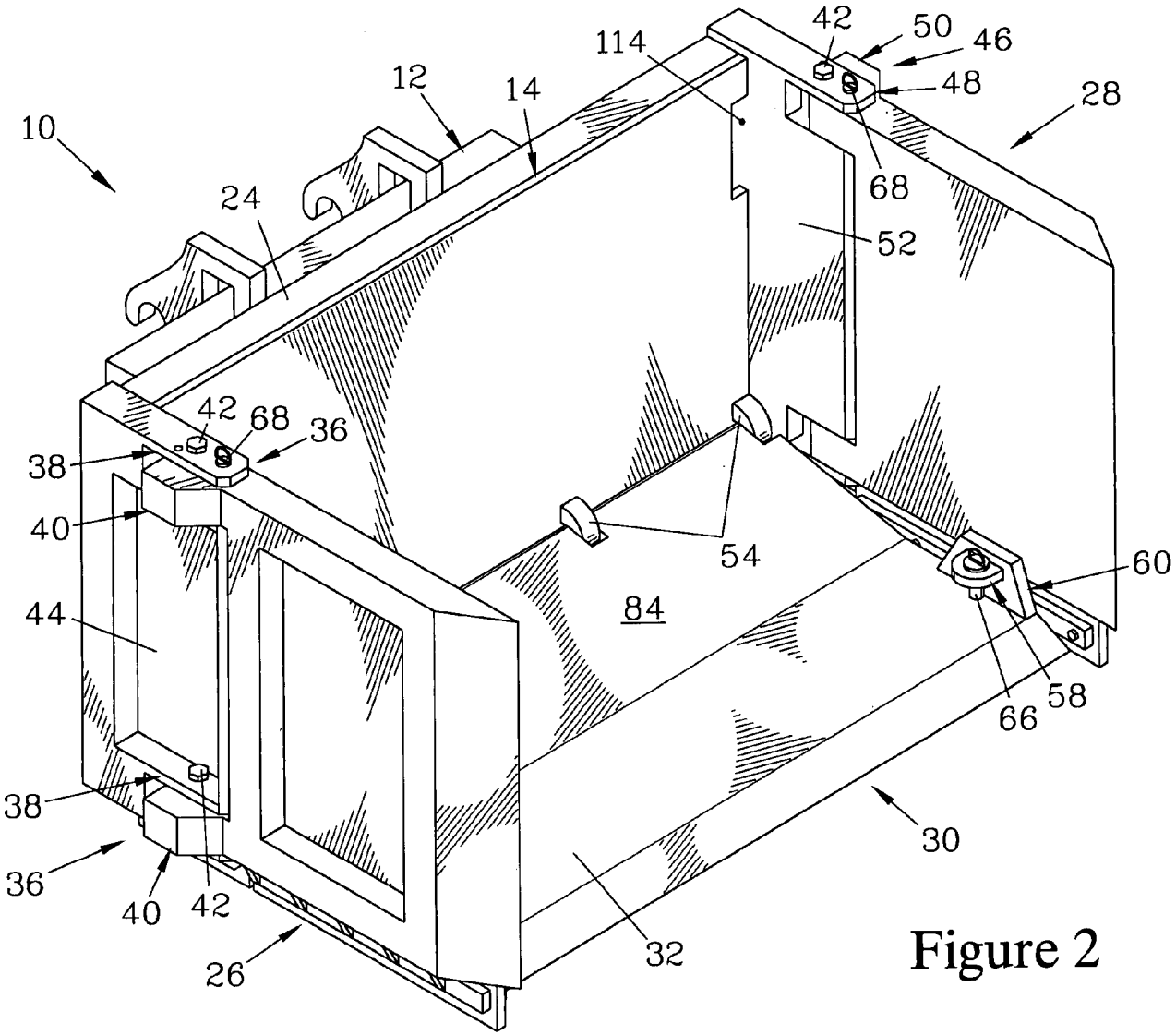
FIG. 2 is an assembled isometric view of the embodiment shown in FIG. 1 when configured to function as a bucket. The drop blade is retained in its lowered position and the first and second wings are positioned normal to the back plate. The drop blade serves as the bottom surface of a loading bucket, while the back plate and the wings provide the sides of the loading bucket. In this embodiment, the drop blade is retained in its lowered position by wing tongues on each of the wings that are received into drop blade brackets attached to the drop blade and secured therein by tongue pins.

FIG. 2 is the same view of the pusher/bucket 10 as shown in FIG. 1; however, the view is an assembled view, showing the pusher/bucket 10 in its bucket configuration. The wings (26 and 28) of this embodiment are each provided with a wing tongue 58 (only one of which is shown). The drop blade 30 is provided with a pair of drop blade brackets 60, each having a tongue slot 62 through which the corresponding wing tongue 58 can pass.

The wing tongues 58 and drop blade brackets 60 serve as a means to maintain the drop blade 30 in the lowered position. Furthermore, the tongue slots 62 are preferably positioned such that the substantially planar lead region 32 of the drop blade 30 is normal to the back plate 14 when the drop blade 30 is in the lowered position. When the drop blade 30 is so positioned, the back scraping edge 22 of the back assembly 12 preferably lies in the plane of the substantially planar lead region 32, thereby assuring that the drop blade 30 skims the surface over which the pusher/bucket 10 passes.

The wing tongues 58 each have a tongue passage 64 therethrough (as shown in FIG. 1), such that when the wing tongues 58 are passed through the tongue slots 62 and the wings (26 and 28) are positioned normal to the back plate 14, the drop blade brackets 60 each reside between one of the tongue passages 64 and the corresponding wing (26, 28). Tongue pins 66 (one of which is shown in FIG. 2) can then be placed through the tongue passages 64 to maintain the tongues 58 engaged in the tongue slots 62 to prevent spreading of the wings (26 and 28) as the bucket is filled. The tongue pins 66 also serve, at least in part, to maintain the wings (26 and 28) normal to the back plate 14. The wings (26 and 28) in this embodiment are also maintained normal to the back plate 14 by wing position pins 68 (shown in FIG. 2) which each pass through a bracket first positioning passage 70 in one of the wing brackets (38 and 48) as well as through a wing tab passage 72 in the corresponding wing tab (40, 50). Bracket second positioning passages 74 (best shown in FIG. 1) are provided to secure the wings (26 and 28) in alternate positions. The bracket second positioning passages 74 allow the wing positioning pins 68 to lock the wings (26 and 28) in alternate positions, as discussed in greater detail below in the description of FIGS. 10-12.

Figure 3:
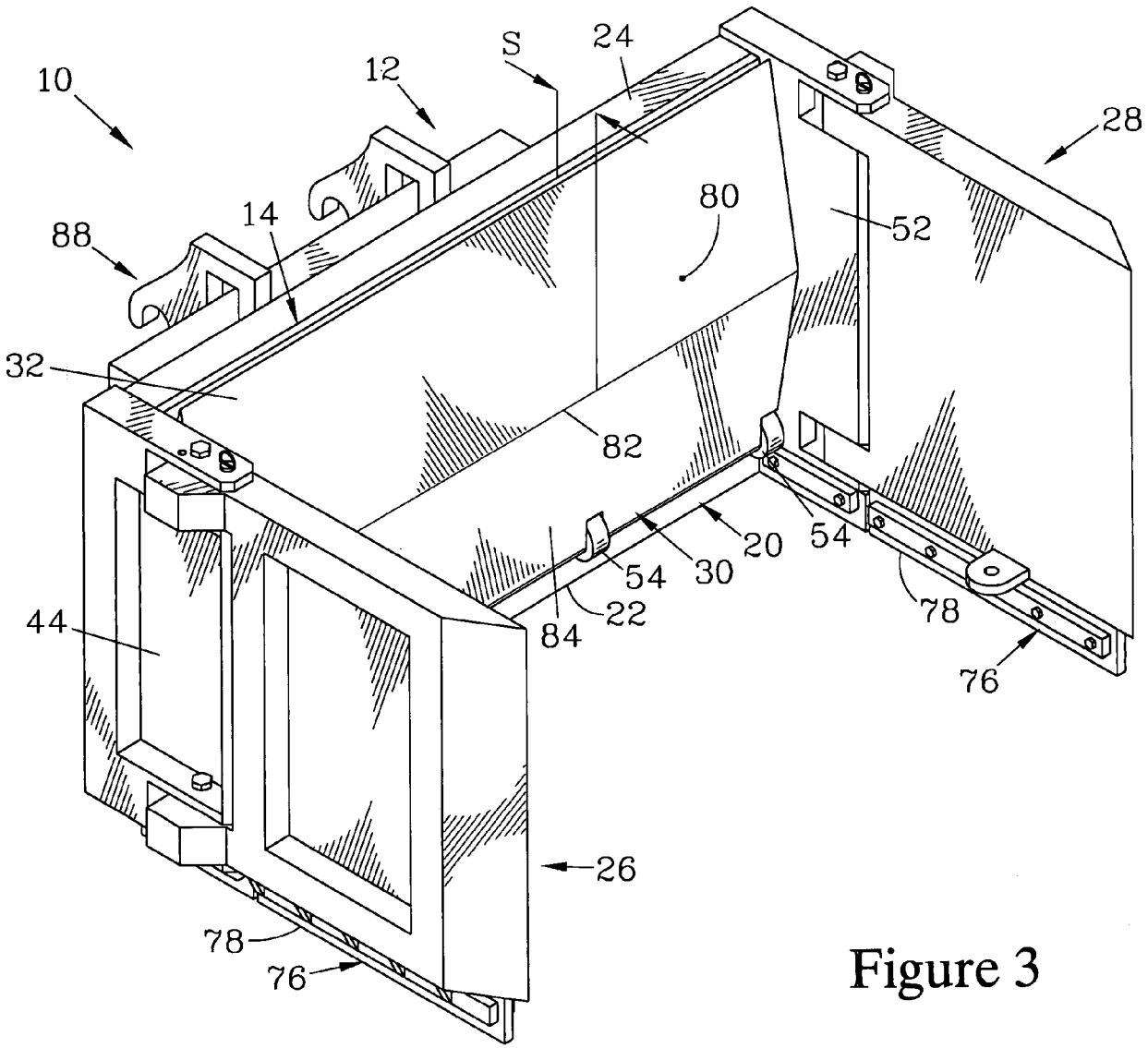
FIG. 3 is an isometric view of the embodiment shown in FIGS. 1 and 2 when the drop blade is in its raised position and the wings are positioned normal to the back plate. In this position, the pusher/bucket can be used as a pusher to move material directionally, pushing primarily with the lower surface of the drop blade, which is superimposed over the back plate.

FIG. 3 is another isometric view of the embodiment illustrated in FIGS. 1 and 2, illustrating the pusher/bucket 10 when the drop blade 30 is in its raised position and the wings (26 and 28) extend normal to the back plate 14. This position of the drop blade 30 and the wings (26 and 28) allows pushing material where there is insufficient area to allow the wings (26 and 28) to be spread. This configuration also reduces spill-out of the material being pushed. In order to further reduce spill-out, it is preferred to maintain a minimal gap between the wings (26 and 28) and the blocking plates (44 and 52) or, alternatively, provide seals which cover these gaps. The latter approach is discussed below in the discussion of FIGS. 18-20. In the present embodiment, the wings (26 and 28) are each provided with a wing scraper 76 that terminates in a wing scraping edge 78 that is essentially co-planer with the back scraping edge 22 of the back assembly 12. These wing scrapers 76 are preferably fabricated from a resilient material such as nylon or rubber so as to allow deflection of the wing scrapers 76 if they encounter an irregularity in the surface over which they are traversing. Nylon is preferred for greater durability and resistance to tearing than rubber.

When the drop blade 30 is raised, it is superimposed over the back plate 14, and material is pushed by a drop blade outer surface 80 of the drop blade 30. The drop blade outer surface 80, in turn, serves as the lower surface of the drop blade 30 when it is lowered. When the drop blade 30 is in its raised position, the drop blade outer surface 80 has a maximum separation S from the back plate 14. The drop blade 30 preferably has a dihedral configuration with an angle between plate sections such that the maximum separation S occurs at a ridge 82 resulting from the junction between the substantially planar lead region 32 and a substantially planar base region 84, which pivotably attaches to the drop blade mount brackets 54 of the back assembly 12.

Figure 4:
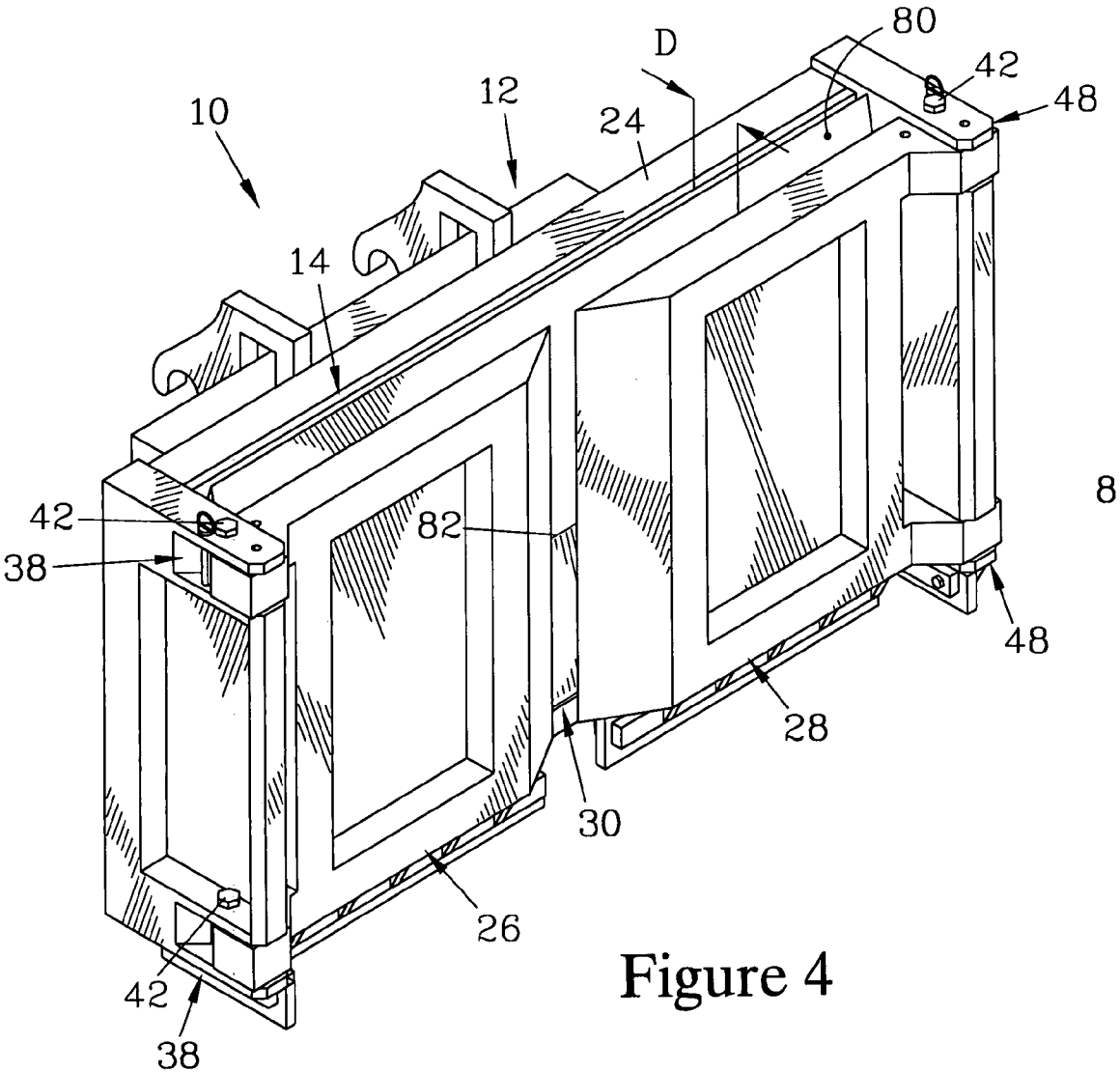
FIG. 4 is another isometric view of the embodiment shown in FIGS. 1-3 when the wings have been folded inward so as to reside parallel to the back plate, with the raised drop blade positioned therebetween. The wing hinges position the axes about which the wings pivot a sufficient distance away from the back plate to allow the drop blade to be accommodated between the wings and the back plate. In this position, the pusher/bucket can be used to push material with the back surfaces of the wings.

FIG. 4 illustrates the embodiment illustrated in FIGS. 1 through 3 when the wings (26 and 28) are folded such that they are parallel to the back plate 14. The first pair of wing brackets 38 and the second pair of wing brackets 48 are configured to place the pivot pins 42 forward of the back plate 14, resulting in the wings (26 and 28) being spaced apart from the back plate 14 by a separation D. When the wings (26 and 28) are positioned parallel to the back plate 14, the pusher/bucket 10 is configured to serve as a conventional plow and will have its minimum sweep configuration. In this configuration, the material being pushed by the pusher/bucket 10 will tend to roll off to the side of the path being swept by the pusher/bucket 10. When the pusher/bucket 10 is moved forward, the wings (26 and 28) are maintained parallel to and at a separation D from the back plate 14 by having the wings (26 and 28) rest against the ridge 82 of the drop blade 30. When the separation D is equal to the maximum separation S of the drop blade 30 from the back plate 14, a line of support for the wings (26 and 28) along the ridge 82 results, providing support for the pushing surface of the pusher/bucket 10.

Figure 5:
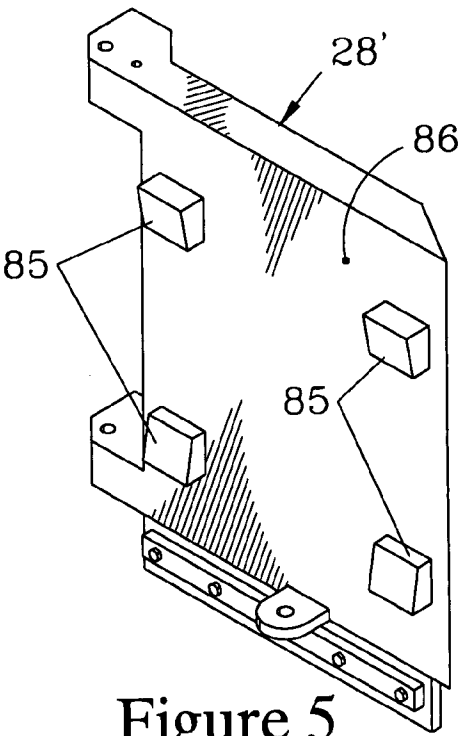
FIG. 5 is an isometric view of the second wing of the embodiment shown in FIGS. 1-4 when optional support blocks have been attached to an inner surface of the wing to provide greater area for support against the drop blade when the second wing is in the position shown in FIG. 4.

When additional support for the wings (26 and 28) in the folded position is desired, such can be provided by attaching optional support blocks 85, such as illustrated in FIG. 5 attached to the wing 28'. The support blocks 85 are affixed to an inner surface 86 of the wing 28' to increase the area of contact between the wing 28' and the drop blade 30. The support blocks 85 are configured to supportably engage the drop blade outer surface 80 when the wing 28' is folded in to rest against the drop blade 30, the position shown in FIG. 4. In fact, the support blocks 85 can be configured to provide support for the wing 28' in the event that S<D.

Figure 6:
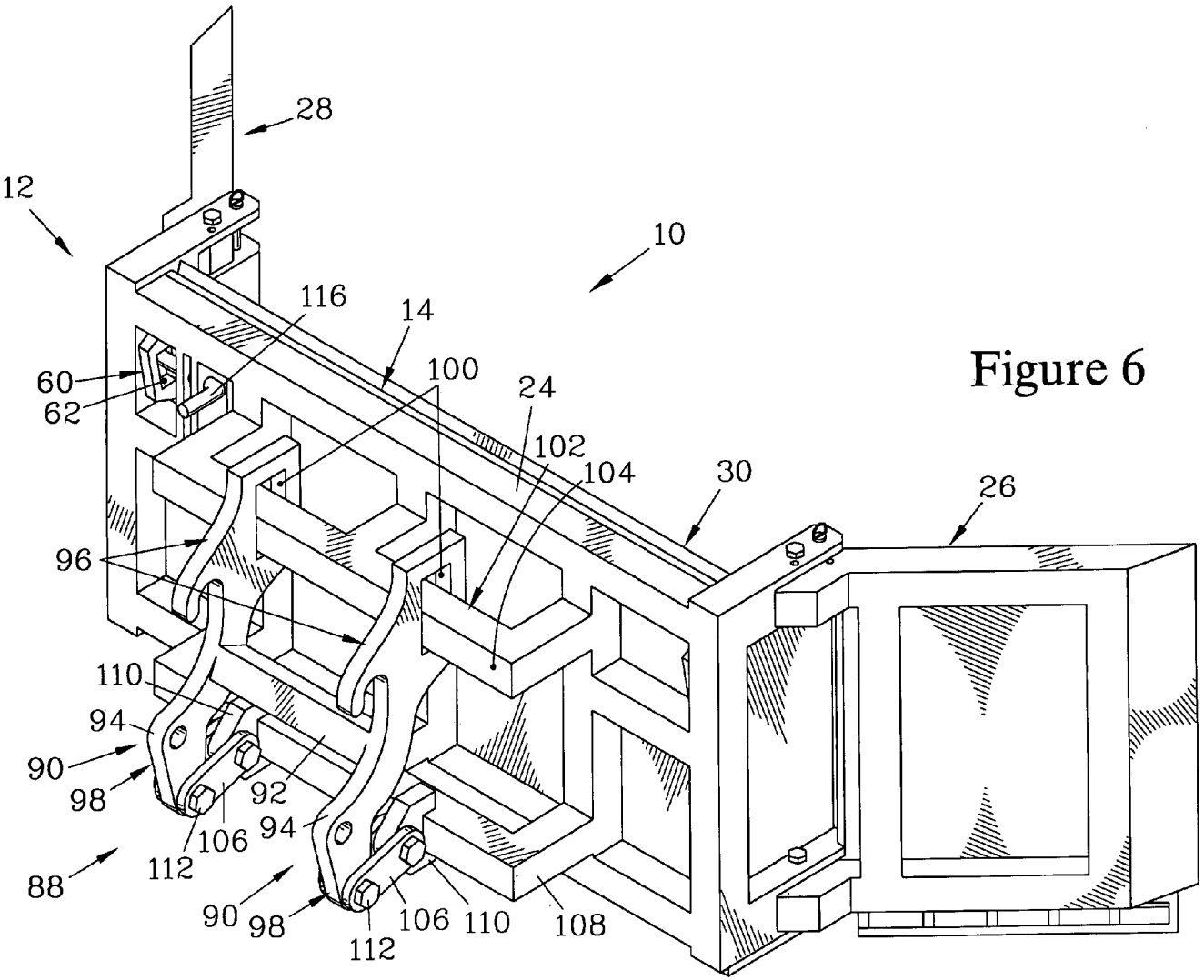
FIG. 6 is an isometric view from the rear looking toward the pusher/bucket of the embodiment shown in FIGS. 1-4. This perspective shows details of a float mechanism of the pusher/bucket that serves as a coupler between a standard instant transfer mechanism and the pusher/bucket to allow the pusher/bucket to float over an uneven ground surface. The float mechanism illustrated has an upper transfer bar and a lower transfer bar, both of which are affixed to the back frame so as to extend horizontally and be spaced apart from the back frame. A support structure has a pair of substantially vertical supports that have rear profiles configured with mounting hooks and securing pin passages to allow mounting to a conventional loader vehicle mount. Each of the substantially vertical supports has a substantially vertical slot through which the upper transfer bar passes, the substantially vertical slot being configured to restrain the upper horizontal transfer bar to limit its motion. A link is pivotably attached to each of the substantially vertical supports and to lugs affixed to the lower transfer bar. These links limit lateral shifting of the upper transfer bar with respect to the vertical slots and are also so positioned and connected as to counter torsional loads on the upper transfer bar as the scraping edges of the pusher/bucket are drawn across the surface being cleared.

FIG. 6 is a rear view of the pusher/bucket 10 where the wings (26 and 28) are extended outward and forward at 45° to provide a broader sweep. FIG. 6 better illustrates the back frame 24 and a float mechanism 88 employed to assist the pusher/bucket 10 to make accommodations for irregularities in the surface over which it traverses, such as abrupt changes in elevation of the surface and/or having the surface configured such that it promotes pivoting of the pusher/bucket 10 normal to the direction of advancement to accommodate falloff in grade. A pair of substantially vertical supports 90 are provided, which are attached to a spacing bar 92 which maintains the spacing between the substantially vertical supports 90 at a proper separation so as to slidably engage a standard instant transfer connector such as a Caterpillar IT. The substantially vertical supports 90 have rear profiles 94 that are configured so as to slidably and lockably engage an instant transfer connector (not shown). The substantially vertical supports 90 have upper regions 96 and lower regions 98. The upper regions 96 have vertical slots 100 that are aligned. An upper transfer bar 102 passes through the slots 100 and attaches to the back frame 24 of the pusher/bucket 10. The upper transfer bar 102 has a rectangular cross section, having a pair of spaced apart parallel sides 104 (only one of which can be seen) so spaced that the upper transfer bar 102 can slidably but not rotationally engage the slots 100, thus providing motion which is substantially limited to vertical motion.

Links 106 are pivotally joined to the lower regions 98 of the substantially vertical supports 90, and are also tied into the back frame 24 via a lower transfer bar 108 by connecting to link brackets 10. These links 106 serve dual functions, preventing both lateral motion between of the back frame 24 with respect to the float mechanism 88 and rotational rocking of the back frame 24 with respect to the float mechanism 88. The position of the links 106 and their connection to the substantially vertical support 90 and lower transfer bar 108 are so configured that the links 106 are positioned to substantially eliminate rocking motion (rotation of the vertical slots 100 with respect to the upper transfer bar 102). Blocking this motion eliminates binding of the transfer bar 102 in the substantially vertical slots 100, which would otherwise prevent the vertical adjustment of the pusher/bucket 10 as it seeks to rise and fall to follow the surface over which it passes. Since the links 106 move in arcs, there must be limited play in the connection between the upper transfer bar 102 and the vertical slots 100, the links 106 and either of the elements which they join or both.

Bolts 112 are employed to attach the links 106 with the substantially vertical supports 90 and the lower transfer bar 108. The bolts 112 must have shafts which are undersized with respect to the passages in the substantially vertical supports 90 and the link brackets 110 so as to permit limited independence between the motion of the links 106. There must be sufficient play between the links 106 and the elements to which they connect to allow the transfer bars (102, 108) to tilt side-to-side to allow the pusher/bucket 10 to pitch as it traverses uneven terrain. It has been found that undersizing the bolts 112 by about ⅛ inch (3 mm) and spacing the links 106 about ⅛ inch (3 mm) wider than the thickness of the substantially vertical supports 90 and the link brackets 110 is sufficient to provide the freedom needed for the effective operation of the links 106 to allow side-to-side tilting. Similarly, it has been found that spacing the parallel sides 104 of the upper transfer bar 102 about ¼ inch (6 mm) narrower than the substantially vertical slots 100 is sufficient to guide the motion of the back frame 24 without undue tendency to bind.

FIG. 6 also illustrates the means employed in this embodiment to secure the drop blade 30 in its raised position (the position best seen in FIG. 3). In this embodiment, the drop blade brackets 60 pass through plate slots 114 (one of which is shown in FIGS. 1 and 2) such that at least a portion of the tongue slot 62 resides behind the back plate 14 and can be engaged by a blade retaining pin 116 to secure the drop blade 30 in the raised position. The blade retaining pin 116 is preferably slidably engaged with the back frame 24.

While the float mechanism 88 shown in FIG. 6 allows the pusher/bucket 10 to traverse uneven terrain, it is desirable in some situations to disable the float mechanism 88. This is particularly true when the pusher/bucket 10 is configured as a loading bucket (the position shown in FIG. 2) for lifting and dumping material. During such operations, if the back frame 24 is free to move relative to the substantially vertical supports 90, the movement can result in banging of the elements when material is dumped. This banging can promote wear and is undesirably noisy when the pusher/bucket 10 is used for removing material such as snow in a residential area.

Figure 7:
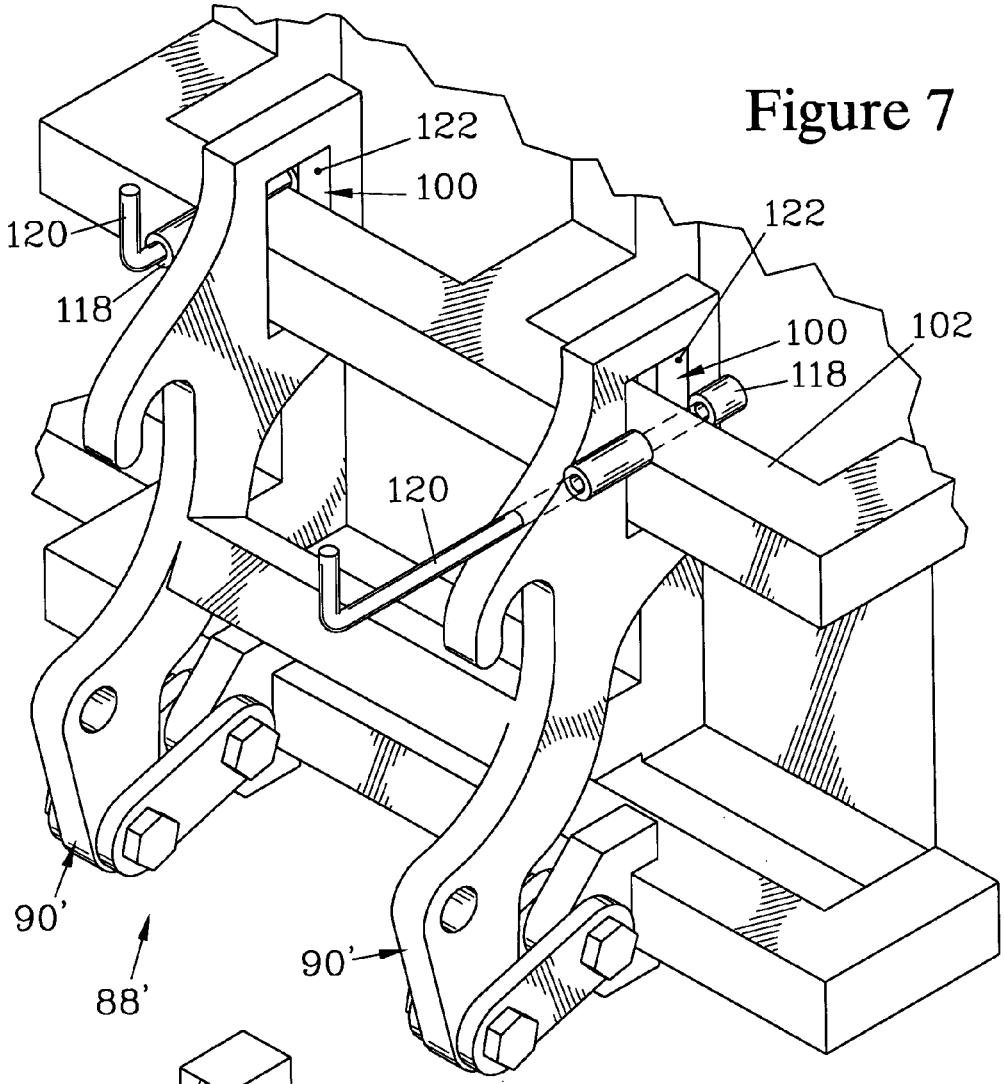
FIG. 7 is a partial isometric view which illustrates a float mechanism similar to that shown in FIG. 6, but which allows the motion of the upper transfer bar in the vertical slots to be restricted. Restricting the motion of the upper transfer bar disables the float mechanism to prevent excess noise when the pusher/bucket is configured as a bucket for loading and dumping material. Float disablement sleeves are attached to each of the substantially vertical supports, and float disablement pins can be inserted into the float disablement sleeves to block the upper transfer bar from moving upwards in the vertical slots.

FIG. 7 is a partial view illustrating a float mechanism 88' that includes structure to disable the floating action. Each of the substantially vertical supports 90' has a float disablement sleeve 118 affixed thereto. A pair of float disablement pins 120 are provided, which can be inserted into the float disablement sleeves 118. The float disablement sleeves 118 are positioned such that, when the float disablement pins 120 are positioned therein, the float disablement pins 120 act to block an upper portion 122 of the vertical slots 100 to prevent upwards motion of the upper transfer bar 102 in the vertical slots 100.

Figure 8:
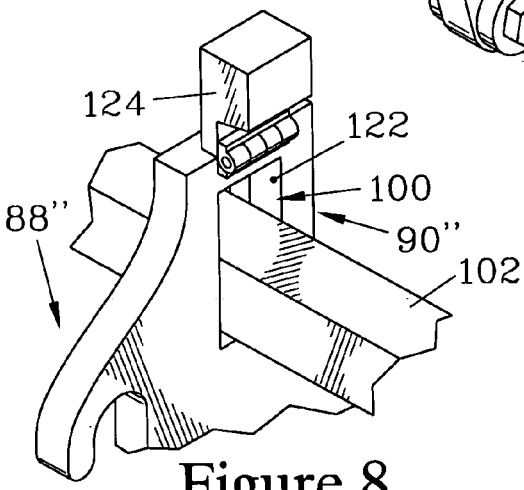
FIGS. 8 and 9 are partial views that illustrate an alternative structure for blocking motion of the upper transfer bar in the vertical slots. In this embodiment, a float disablement block is pivotably mounted to each of the substantially vertical supports. The float disablement block can be pivoted between an inactive block position, shown in FIG. 8, where it does not limit the motion of the upper transfer bar, and an active block position, shown in FIG. 9, where the float disablement block prevents the upper transfer bar from moving upwards in the vertical slot.
Figure 9:
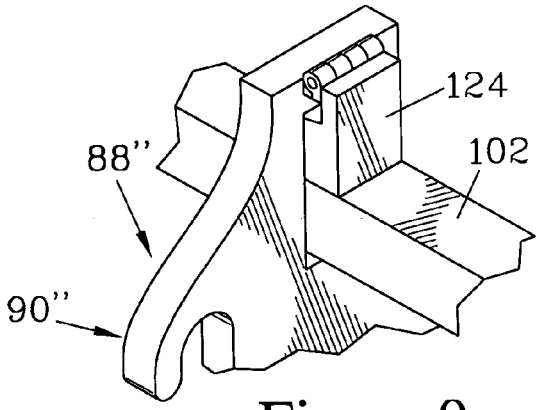

FIGS. 8 and 9 illustrate another scheme for disabling the float mechanism 88". In this embodiment, each of the substantially vertical supports 90" has a float disablement block 124 pivotably attached thereto. The float disablement block 124 can be pivoted to an inactive block position, shown in FIG. 8, where it resides above the vertical slot 100 and does not impede the motion of the upper transfer bar 102; in this position, the upper transfer bar 102 is free to move in the vertical slot 100 to allow floating over uneven terrain. When loading operations are desired, the float disablement block 124 is pivoted to an active block position, shown in FIG. 9, where it is positioned to block the upper portion 122 of the vertical slot 100 to prevent the upper transfer bar 102 from moving upwards in the vertical slot 100.

Figure 10:
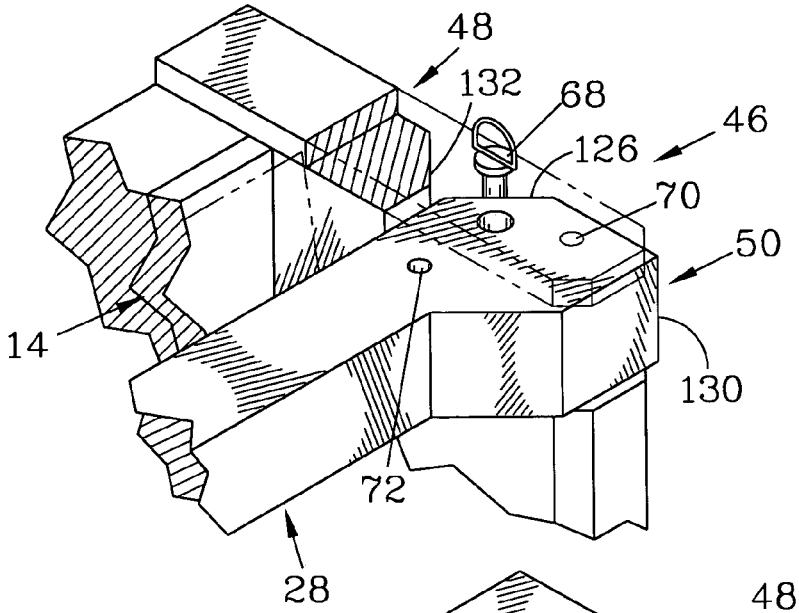
FIGS. 10 through 12 are partially sectioned isometric views illustrating the interaction between one of the wing tabs and the corresponding wing bracket of the embodiment shown in FIGS. 1-6, with the drop blade omitted for clarity.
Figure 11:
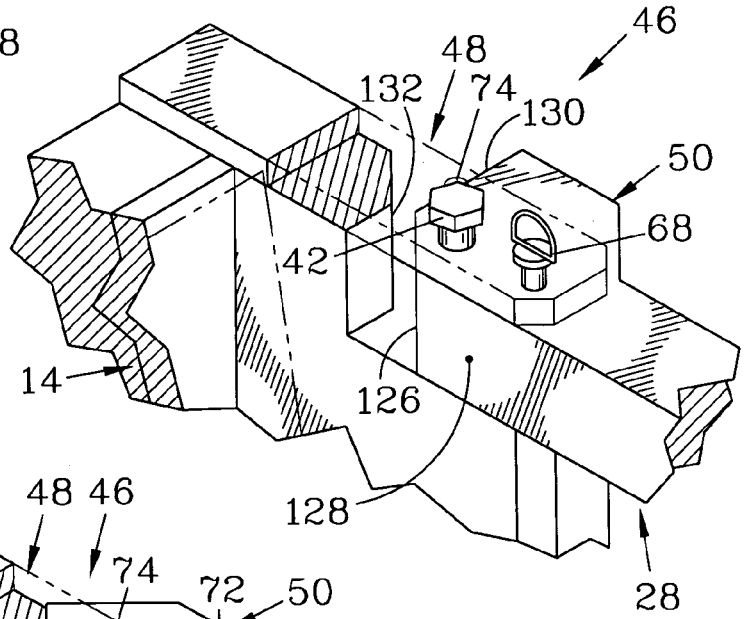
Figure 12:
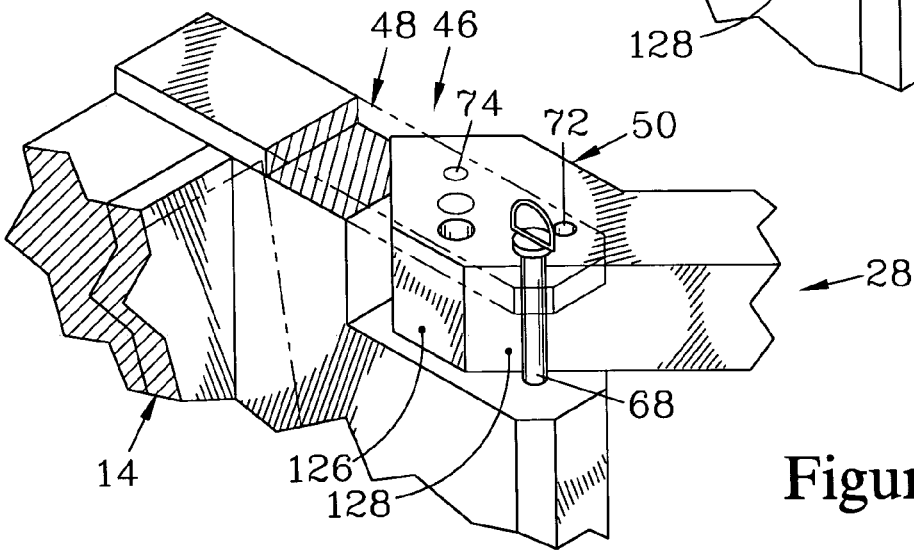

FIGS. 10-12 are isometric views showing greater details of one hinge of the second pair of hinges 46 employed in the embodiment illustrated in FIGS. 1 through 6. FIG. 10 illustrates the hinge 46 when positioned to maintain the second wing 28 parallel to the back plate 14 (the position shown in FIG. 4) and is a partial view of the hinge 46 with one of the second wing brackets 48 shown partially in phantom. The second wing 28 is prevented from moving toward the back plate 14 by its contact with the ridge 82 of the drop blade 30 (shown in FIGS. 3 and 4). It is blocked from pivoting away from the back plate 14 by the wing positioning pin 68, which is maintained in the bracket second positioning passage 74 (shown in phantom in FIGS. 11 and 12) and is positioned to engage a first tab stop surface 126 (best shown in FIG. 9) on one of the second wing tabs 50 when the second wing 28 attempts to pivot away from the back plate 14.

FIG. 11 illustrates the hinge 46 when the second wing 28 is maintained in a position normal to the back plate 14 (the position shown in FIGS. 2 and 3). In this position, the wing positioning pin 68 passes through the bracket first positioning passage 70 (shown in phantom in FIG. 10) and through the wing tab passage 72 (shown in FIGS. 10 and 12).

FIG. 12 is a view corresponding to that of FIGS. 10 and 11, where the second wing 28 is in an extended position, and extends forward and outward from the back plate (the position shown in FIG. 6). The wing position pin 68 again passes through the bracket first positioning passage 70, where the wing positioning pin 68 is positioned to engage a second tab stop surface 128 on the wing tab 50 to prevent the wing 28 from pivoting inward. A third tab stop surface 130 (shown in FIGS. 10 and 11) on the wing tab 50 engages a bracket stop surface 132 (also shown in FIGS. 10 and 11) on the wing bracket 48 to prevent the wing 28 from pivoting further outward.

FIG. 13 is an inverted isometric view of a section of a back scraping blade 150, seen from the front, while FIG. 14 is a view from the rear. The back scraping blade 150 is similar to the back scraping blade 20 of the embodiment illustrated in FIGS. 1-12. The back scraping blade 150 is mounted to a shoe 152, which provides flexible coupling to allow the back scraping blade 150 limited pivotable motion with respect to a back plate 154 affixed to a back frame 156. The shoe 152 is pivotally attached to the back frame 156, allowing deflection of the back scraping blade 150 if shock loaded. The back frame 156 illustrated has a bottom surface 158 with a series of frame brackets 160 (shown in FIG. 14) attached thereto. These frame brackets 160 pivotally engage a series of shoe brackets 162, which in turn mount to the shoe 152. Interposed between the back frame 156 and the shoe 152 is a series of shock absorbers 164, which in this embodiment are resilient cylinders fabricated from a material such as rubber. Since the back scraping blade 150 is subject to wear, it is preferred that it be adjustably mounted to the shoe 152. In this embodiment, such adjustability is provided by a series of adjustment slots 166 (shown in FIG. 13) in the back scraping blade 150 in combination with blade attachment bolts 168 which are sized to slidably engage the adjustment slots 166. A drag bar 170 is provided and attached to the bottom of the shoe 152 to prevent excessive wear resulting from the back dragging of the shoe 152, which will tend to rotate the shoe 152 into the surface it is traversing. The back frame 156 has a lower transfer bar 172 for mounting link brackets 174 to allow attaching links of a float mechanism such as that shown in FIG. 6 to the back frame 156.

FIG. 15 is an isometric view of the same shoe 152 attached to an alternate back frame 156' which does not employ a lower transfer bar 172 for mounting link brackets 174, as does the back frame 156 shown in FIG. 14, but rather has link brackets 174' that are affixed directly to the back frame 156'.

Figures 16, 17:
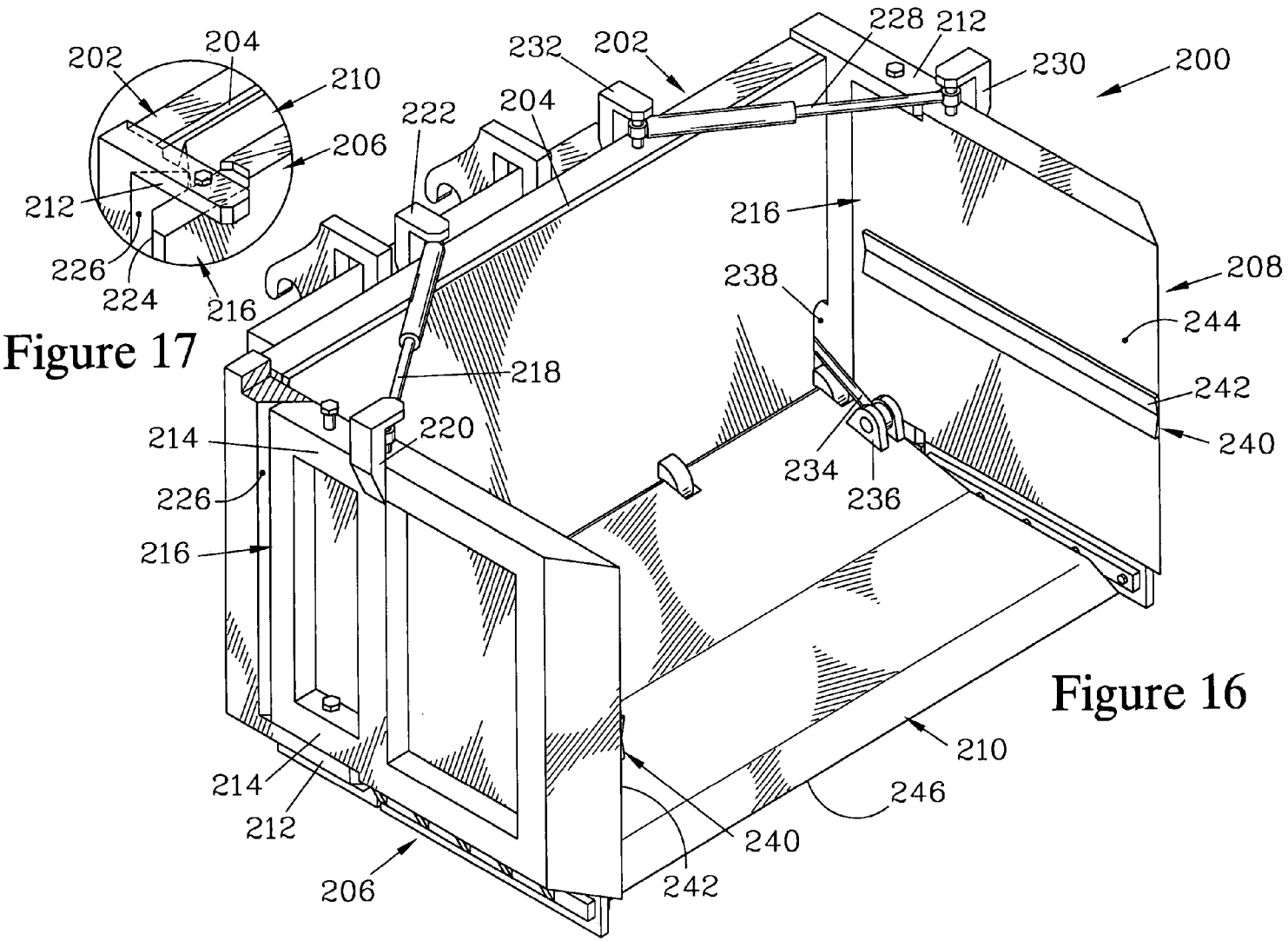
FIG. 16 is an isometric view of another embodiment of the present invention, a pusher/bucket which employs hydraulic cylinders to position the wings and the drop blade, and where the wings assume only two work positions.
FIG. 17 is a partial view of the embodiment shown in FIG. 16 when the wing has been moved to its second working position, where it is folded against the raised drop blade.

FIG. 16 is an isometric view of a pusher/bucket 200 which forms another embodiment of the present invention. The pusher/bucket 200 shares many features in common with the pusher/bucket 10 discussed above. The pusher/bucket 200 has a back assembly 202 with a back plate 204, a first wing 206 and a second wing 208 that are pivotably attached to the back assembly 202, and a drop blade 210 that is pivotably attached to the back assembly 202. The pusher/bucket 200 differs in the means for locking the wings (206, 208) in designated positions and the means for locking the drop blade 210 in its raised and lowered positions. It also differs in that the wings (206 and 208) move between only two operating positions, a first position where the wings (206 and 208) are parallel to the back plate 204 (shown in the partial view of FIG. 17) and a second position where the wings (206 and 208) are normal to the back plate 204, illustrated in FIG. 16. It also differs in that it employs wing brackets 212 that are configured to engage wing tabs 214 that are formed integrally with blocking plates 216, the wing tabs 214 and the blocking plates 216 both being integral parts of the wings (206 and 208).

The position of the first wing 206 is controlled by a first wing actuator 218, which is pivotably connected to the first wing 206 via a first actuator wing bracket 220, and to the back assembly 202 via a first actuator back bracket 222. When the first wing actuator 218 is operated to adjust its length, the first wing 206 is pivoted relative to the back assembly 202. In this embodiment, each of the blocking plates 216 has a blocking plate free end 224 (one of which is shown in FIG. 17) that is configured to sealably engage a mating edge region 226 of the back assembly 202 (again, one of which is shown in FIG. 17).

Similarly, the position of the second wing 208 is controlled by a second wing actuator 228. The second wing actuator 228 is pivotably connected to a second actuator wing bracket 230 affixed to the second wing 208 and to a second actuator back bracket 232 that is affixed to the back assembly 202.

The position of the drop blade 210 is controlled by a pair of drop blade actuators 234 (only one of which is shown, in part). The drop blade actuators are pivotably attached at one end to the back assembly 202 and at the other end to a drop blade actuator bracket 236 affixed to the drop blade 210. A pair of actuator passages 238 are provided in the back plate 204 to accommodate movement of the drop blade actuators 234. Boot seals (not shown) can be provided to seal the actuator passages 238 and still provide for the required movements of the actuators 234.

To provide additional support for the wings (206 and 208) when in the folded position shown in FIG. 17, a support block 240 is attached to an inner surface 242 of each of the wings (206, 208), as shown in FIG. 16. The support blocks 240 in this embodiment are provided with V-shaped faces 244 that are configured to match a dihedral lower surface 246 of the drop blade 210 to provide support for the wings (206, 208) over a greater area.

Figure 19:
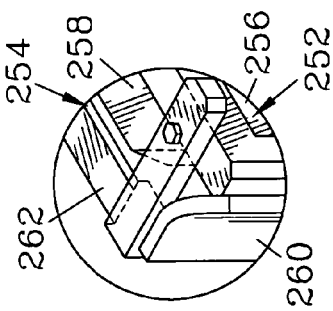
FIG. 19 is a partial view of the embodiment shown in FIG. 18 when the wing is positioned parallel to the drop blade. In this position, the blocking plate and the wing tabs forcibly engage the seal.
Figure 20:
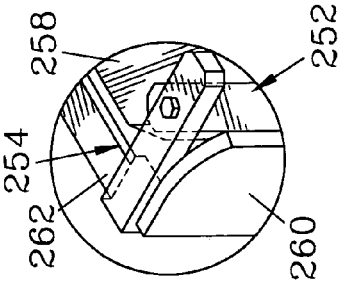
FIG. 20 is a partial view of the embodiment shown in FIGS. 18 and 19 when the wing has been pivoted to an extended position where the included angle between the wing and the back plate is obtuse. In this position, a portion of the wing forcibly engages the seal.
Figure 18:
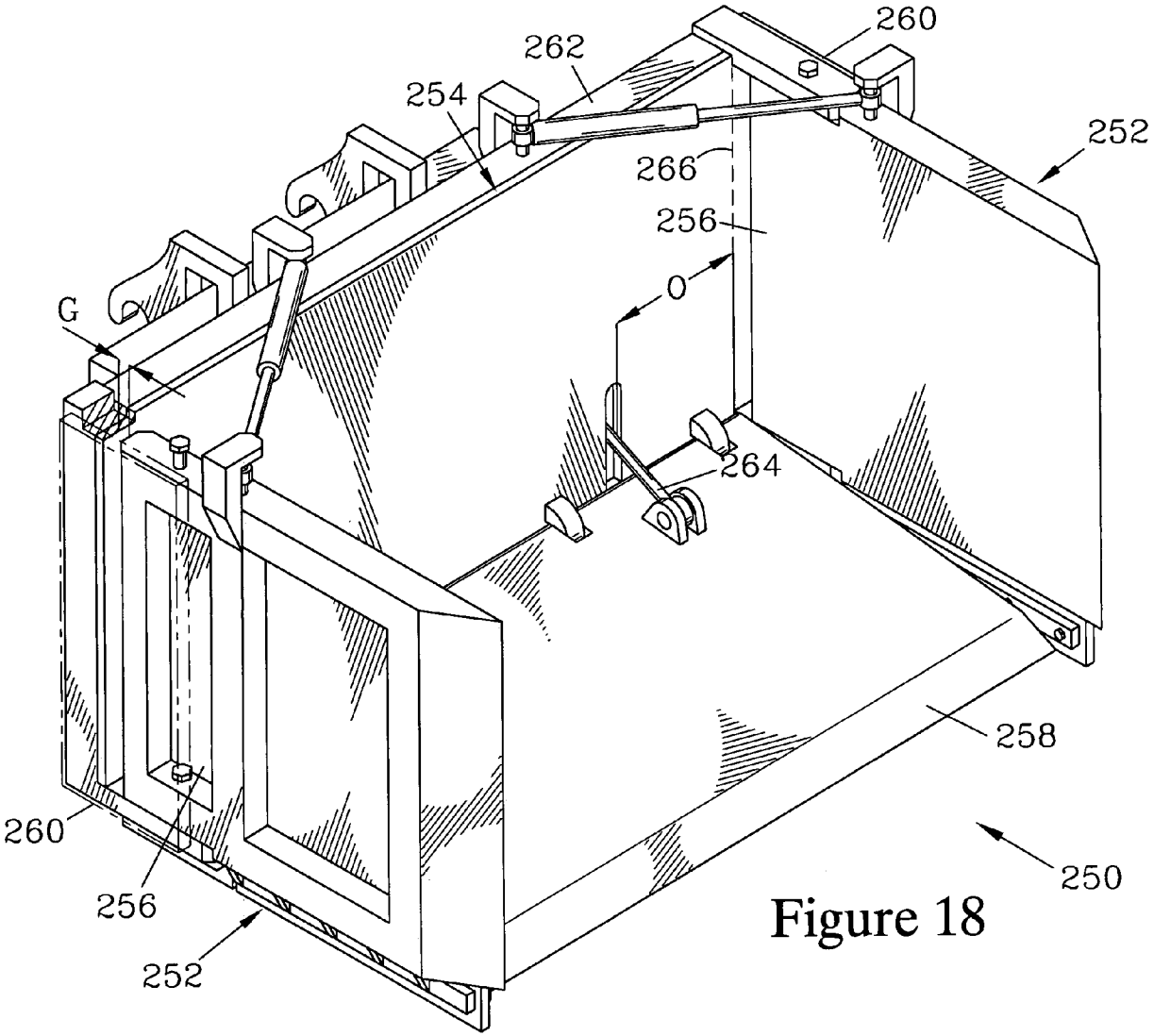
FIG. 18 is an isometric view of another embodiment of the present invention, a pusher/bucket which again employs hydraulic cylinders to position the wings and the drop blade. This embodiment also has blocking plates attached to the wings. Gaps are needed between the blocking plates and the back plate, the size being a function of the details of the drop blade. If the drop blade has a V-cross section, the gaps will need to be larger to allow pivoting the blocking plate past the drop blade when raised; thus, this embodiment employs a planar drop blade. Also, when a hydraulic cylinder is employed to lift the drop blade, it must be positioned clear of the blocking plates in order for the wings to be able to open beyond 90°. Seals over the gaps are provided, and are fabricated from a flexible, resilient material which extends over the residual openings. The seals can also serve to block fines from passing through the gaps.

FIG. 18 is an isometric view of another embodiment of the present invention, a pusher/bucket 250 that differs from the pusher/bucket 200 illustrated in FIG. 16 in that it has wings 252 that can not only be folded inwards as shown in the partial view of FIG. 19 or positioned to extend normal to a back plate 254, but can also be spread outwards so as to provide an angle between the back plate 254 and the wings 252 which is obtuse, as shown in the partial view of FIG. 20. To accomplish this with blocking plates 256 that are integral parts of the wings 252, it is necessary for the blocking plates 256 to be able to be swung both toward and away from each other. To allow the wings 252 to be swung so as to provided an obtuse angle with respect to the back plate 254, it is necessary to maintain a gap G between the blocking plates 256 and the back plate 254. This gap G is needed to allow the blocking plates 256 to swing past a drop blade 258 when the drop blade 258 is in its raised position. The size of the gap G can be reduced somewhat by making the drop blade 258 substantially planar, reducing its separation from the back plate 254 when in its raised position. If the pusher/bucket 250 is to handle material that can readily pass through the gaps G when in the bucket configuration, then seals 260 can be used to cover these gaps G. These seals 260 can be fabricated from a resilient material and affixed to a back frame 262 to block the gaps G. The seals 260 extend sufficiently far forward as to be forcibly engaged by the blocking plates 256 when the wings 252 are folded in and reside over the back plate 254, as shown in FIG. 19. In this embodiment, drop blade actuators 264 (only one of which is shown) are displaced from vertical edges 266 of the back plate 254 by an offset O that is sufficient to allow the blocking plates 256 to pivot past the drop blade actuators 264 without interference.

Figure 21:
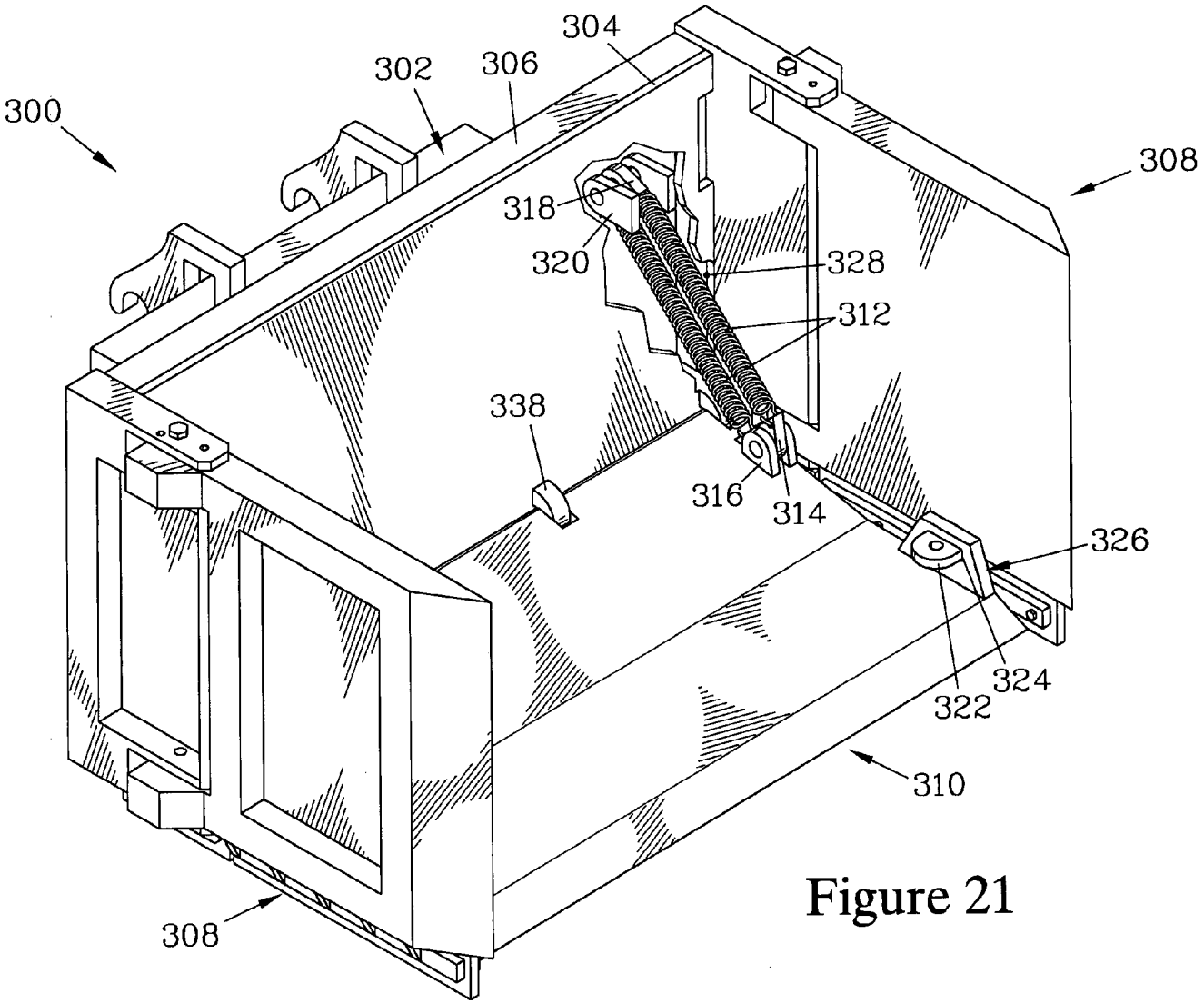
FIG. 21 is an isometric view of a pusher/bucket which forms another embodiment of the present invention. This embodiment employs springs connected between the back frame and the drop blade to counteract the weight of the drop blade as it is raised and lowered.

FIG. 21 is an isometric view of a pusher/bucket 300 which forms another embodiment of the present invention, and again shares many features in common with the pusher/bucket 10 discussed above, having a back assembly 302 with a back plate 304 affixed to a back frame 306, two wings 308 that are pivotably attached to the back assembly 302, and a drop blade 310 that is pivotably attached to the back assembly 302. The pusher/bucket 300 differs in that it incorporates paired springs 312 (only one pair is shown) to counteract the weight of the drop blade 310 when it is moved between its raised and lowered positions.

The springs 312 in each pair are attached at one end to a drop blade spring anchor 314, which in turn is pivotably attached to the drop blade 310 by a drop blade spring bracket 316. At the other end, the springs 312 are attached to a back spring anchor 318, which in turn is pivotably attached to the back frame 306 by a back spring bracket 320. The length of the springs 312 is selected such that, when the drop blade 310 is moved to its lowered position as illustrated, the springs 312 are placed in tension. This tension acts to cushion the decent of the drop blade 310 when it is lowered.

It is preferred for the tension of the springs 312 to be selected relative to the weight of the drop blade 310 such that the drop blade 310 has an equilibrium position somewhat above the lowered position, requiring the user to manually depress the drop blade 310 to place it in its lowered position. This allows the user to adjust the position of the drop blade 310 against the tension of the springs 312 with his or her foot, leaving both hands free to pivot one of the wings 308 so as to slidably engage a wing tongue 322 affixed thereto with a tongue slot 324 of a drop blade bracket 326 on the drop blade 310. The engagement of the wing tongue 322 with the tongue slot 324 maintains the drop blade 310 in its lowered position. When the drop blade 310 is moved to its raised position, the tension of the springs 312 counters the weight of the drop blade 310 and facilitates raising the drop blade 310. Spring passages 328 are provided in the back plate 304 to allow passage of the springs 312 there through.

Figure 22:
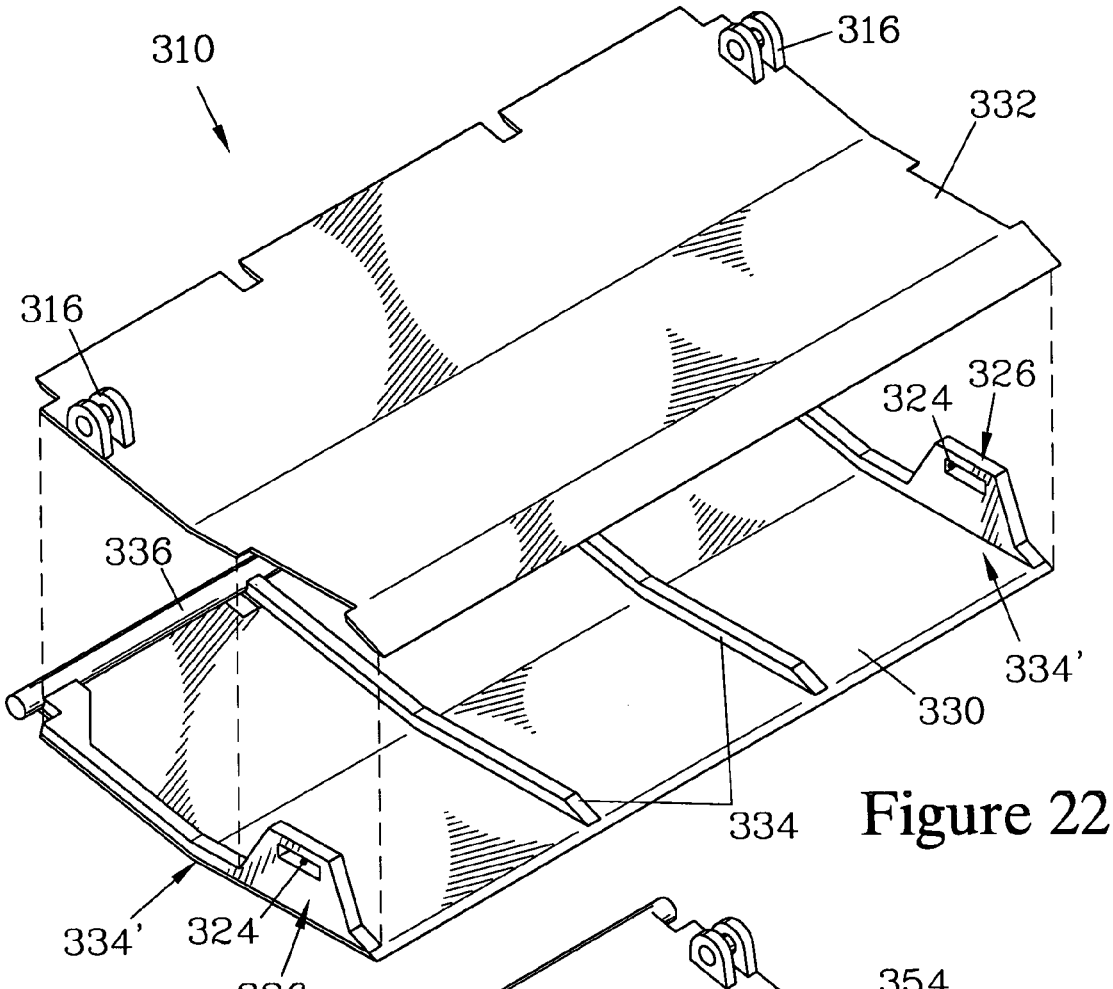
FIG. 22 is a partially exploded isometric view showing a hollow structure for the drop blade shown in FIG. 21 which can result in reduced weight.

FIG. 22 illustrates a preferred configuration for the drop blade 310 employed in the pusher/bucket 300 to reduce weight. The drop blade 310 is formed by a bottom metal sheet 330 and a top metal sheet 332, with a series of ribs 334 attached therebetween. The ribs 334 include outer ribs 334' that have the drop blade brackets 326 formed integrally therewith. Similarly, the ribs 334 provide rigid mounting to one or more pivot rods 336 that serve to attach to drop blade mounting brackets 338 (shown in FIG. 21) on the back frame 306.

Figure 23:
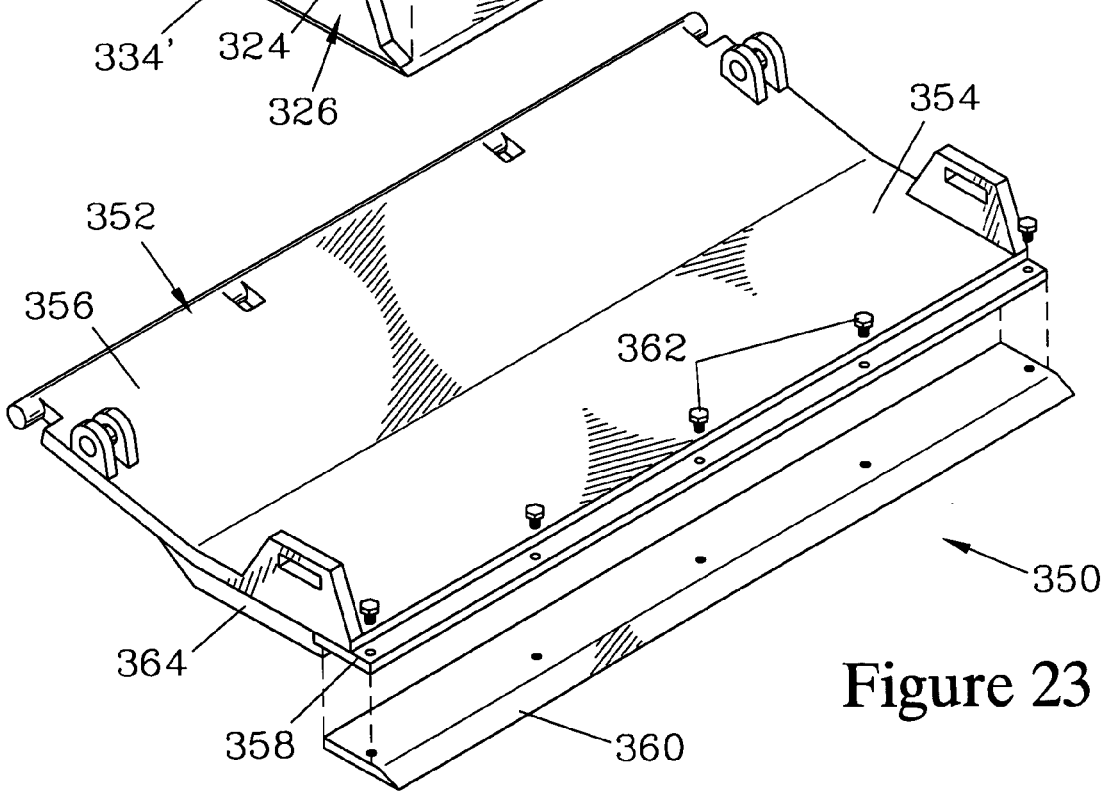
FIG. 23 is a partially exploded isometric view that illustrates another structure for a drop blade which can be employed in the embodiment shown in FIG. 21. This drop blade has a drop blade main body that is formed from a single plate to facilitate fabrication. A mounting bar is affixed to the drop blade main body, and a cutting edge is bolted to the mounting bar, allowing ease of replacement.

FIG. 23 is an exploded isometric view that illustrates a drop blade 350 which can be employed in the embodiment shown in FIG. 18 in place of the drop blade 310 to provide a drop blade that is more easily fabricated. The drop blade 350 has a drop blade body 352 that is formed from a single piece of plate stock. The drop blade body 352 has a planar lead region 354 and a planar base region 356, which is configured to be pivotably mounted to the drop blade mounting brackets 338 (shown in FIG. 21). A mounting bar 358 is affixed to the planar lead region 354, and a cutting edge 360 is attached to the mounting bar 358 by cutting edge bolts 362. The attachment of the cutting edge 360 by the cutting edge bolts 362 allows the cutting edge 360 to be readily replaced when worn or damaged. Preferably, drop blade skids 364 are affixed to the drop blade body 352 to reinforce the drop blade body 352. It is preferred that the drop blade body 352 be at least ¼ inch (6 mm) thick to assure sufficient rigidity to handle the loads that the drop blade 350 is likely to experience in service.

Figure 24:
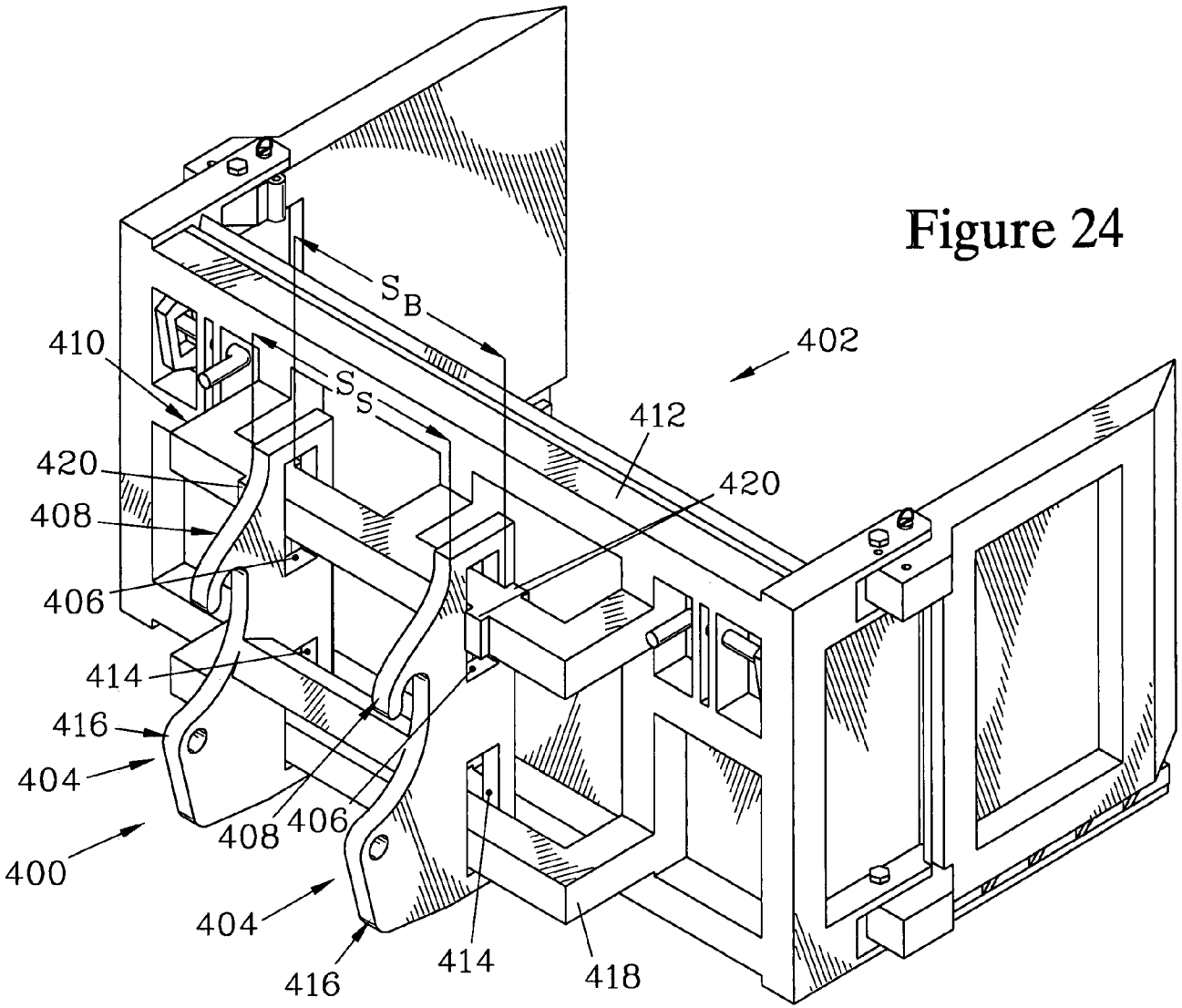
FIG. 24 illustrates an alternative float mechanism that does not employ links. In this embodiment, the substantially vertical supports each have both an upper vertical slot, located in the upper region and slidably engaged by the upper transfer bar, and a lower vertical slot, located in the lower region and slidably engaged by the lower transfer bar. The upper transfer bar is provided with transfer bar protrusions that limit lateral translation of the back assembly with respect to the substantially vertical supports.

FIG. 24 illustrates a float mechanism 400 that provides the same function as the float mechanism 88 shown in FIG. 6, but which does not employ links to limit the relative motion between the float mechanism 400 and a pusher/bucket 402. The float mechanism 400 again has a pair of substantially vertical supports 404, each having an upper vertical slot 406 located in an upper region 408. The upper vertical slots 406 are slidably engaged by an upper transfer bar 410 that in turn is affixed to a back frame 412 of the pusher/bucket 402.

In this embodiment, the substantially vertical supports 404 each have a lower vertical slot 414, located in a lower region 416. The lower vertical slots 414 are slidably engaged by a lower transfer bar 418 that in turn is affixed to the back frame 412. The lower vertical slots 414 are parallel to the upper vertical slots 406. The combination of the lower transfer bar 418 and the lower vertical slots 414 provide means for limiting rotation between the upper transfer bar 410 and the upper vertical slots 406, since the transfer bars (410, 418) and the vertical slots (406, 414) serve to maintain the back frame 412 aligned to prevent binding. It should be noted that, when two transfer bars are employed, they need not have parallel sides for engaging the vertical slots. It should also be noted that both the upper vertical slots and the lower vertical slots could be provided by a single vertical slot in each substantially vertical support, if it can be constructed with sufficient strength.

The upper transfer bar 410 is provided with transfer bar protrusions 420 that are positioned to limit lateral translating motion of the back frame 412 with respect to the substantially vertical supports 404, while still allowing side-to-side tilting. The transfer bar protrusions 420 in this embodiment are spaced apart by a block separation $S_B$ that is somewhat greater than a support separation $S_S$ between the substantially vertical supports 404. Preferably, the block separation $S_B$ is about two inches (5 cm) greater than the support separation $S_S$ to allow side-to-side tilting of the back frame 412 with respect to the substantially vertical supports 404. Alternatively, the transfer bar protrusions 420 could be located between the substantially vertical supports 404, or could be placed on either side of one or both of the substantially vertical supports 404.

In combination, the dual vertical slots (406, 414) and the transfer bar protrusions 420 provide means for stabilizing the upper transfer bar 410 in the upper vertical slots 406.

Figure 25:
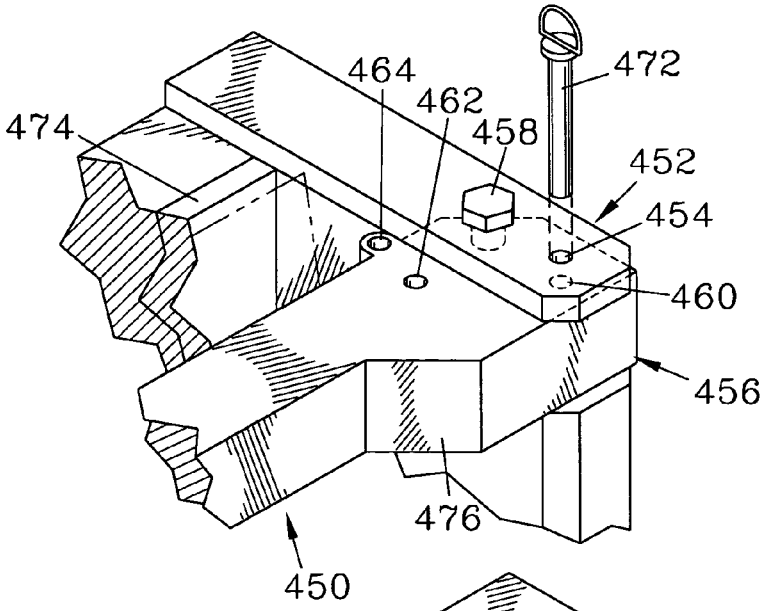
FIGS. 25 through 27 are partial views similar to views illustrated in FIGS. 10 through 12, showing another embodiment of a hinge structure for maintaining one of the wings in either a folded position, a normal position, or an extended position, this embodiment using a single bracket positioning passage. Part of the bracket is shown in phantom in FIGS. 26 and 27.
Figure 26:
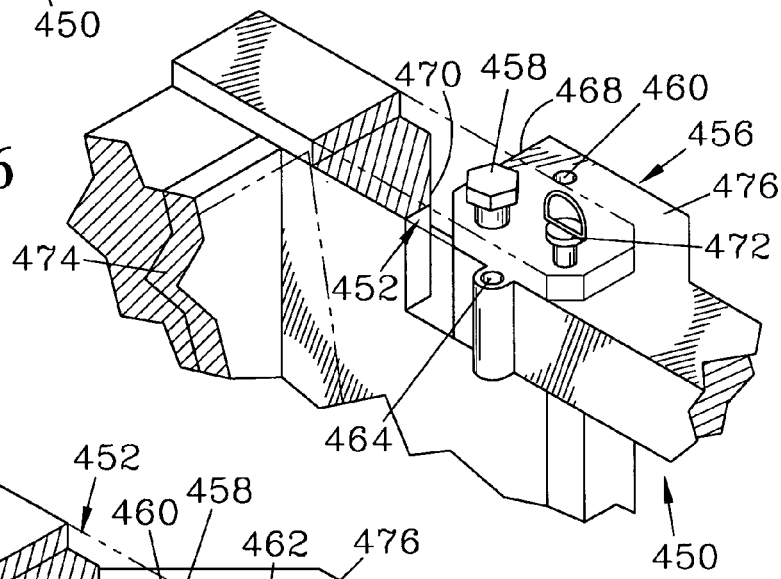
Figure 27:
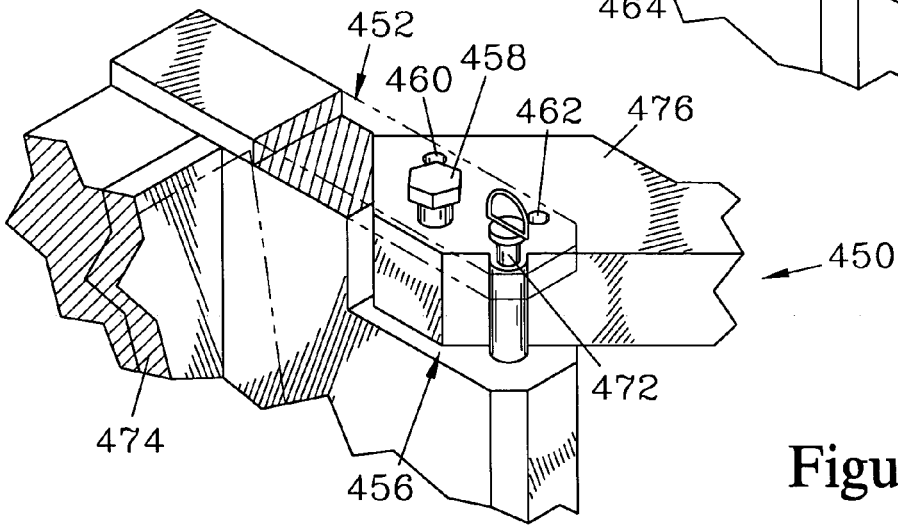

FIGS. 25 through 27 are partial views of an alternate hinge structure to the structure shown in the views of FIGS. 10-12, and again is a hinge structure for maintaining a wing 450 in any of three positions. This hinge structure employs a wing bracket 452 having a single bracket positioning passage 454 (shown in FIG. 25), providing greater structural integrity for the wing bracket 452.

The wing 450 has a wing tab 456 that is pivotably attached to the wing bracket 452 by a wing pivot pin 458. The wing tab 456 is provided with a first wing tab passage 460 (shown in FIGS. 26 and 27), a second wing tab passage 462 (shown in FIGS. 25 and 27), and a third wing tab passage 464 (shown in FIGS. 25 and 26). The wing tab 456 also has a wing tab stop surface 468, while the wing bracket 452 has a corresponding bracket stop surface 470 (both shown in FIG. 26).

A wing positioning pin 472 is inserted into the bracket positioning passage 454 when aligned with one of the wing tab passages (460, 462, 464) and passes through the desired wing tab passage (460, 462, 464) to maintain the wing 450 in the desired position. FIG. 25 shows the wing 450 when the first wing tab passage 460 is aligned with the bracket positioning passage 454, and the wing 450 is folded so as to extend parallel to a back plate 474.

FIG. 26 shows the wing 450 extending normally to the back plate 474, positioned such that the second wing tab passage 462 is aligned with the bracket positioning passage 454. The wing tab 456 preferably has a reinforced region 476 of increased width which extends forward of the second wing tab passage 462 to maintain the structural integrity of the wing tab 456.

FIG. 27 illustrates the wing 450 extending forwards and outwards; in this position, the third wing tab passage 464 is aligned with the bracket positioning passage 454. Because the wing 450 is subject to significant torque when pushing material in the extended position, the wing tab 456 is configured such that the wing tab stop surface 468 engages the bracket stop surface 470 of the wing bracket 452 when the wing 450 is extended. The engagement of the wing tab stop surface 468 and the bracket stop surface 470 accommodates much of the torque on the wing 450, which would otherwise be resisted only by the wing positioning pin 472.

While the novel features of the present invention have been described in terms of particular embodiments and preferred applications, it should be appreciated by one skilled in the art that substitution of materials and modification of details obviously can be made without departing from the spirit of the invention.

What we claim is:

1. A pusher/bucket for moving solids and comprising:

a back assembly having a nominally vertical back plate and a back scraping plate having a back scraping edge;

a first wing having a first wing scraping edge, said first wing being pivotally mounted with respect to said back plate and positionable between a position substantially parallel to and at a separation D from said back plate and at least one position which is substantially normal to said back plate;

means for locking said first wing in designated positions;

a second wing having a second wing scraping edge, said second wing being pivotally mounted with respect to said back plate and positionable between a position substantially parallel to and at a separation D from said back plate and at least one position which is substantially normal to said back plate;

means for locking said second wing in designated positions;

a pivotable drop blade terminating in a cutting edge, said drop blade being attached with respect to said back plate about a drop blade axis so as to pivot between a raised position, where said drop blade resides over said back plate, and a lowered position, where said cutting edge is substantially in a plane formed by said first wing scraping edge and said second wing scraping edge;

said drop blade being configured such that, when said drop blade is in said raised position, it has a maximum separation S from said back plate such that $S \leqq D$;

means for locking said drop blade in said raised position; and means for locking said drop blade in said lowered position.

2. The pusher/bucket of claim 1 wherein said drop blade has a substantially planar lead region that extends substantially normal to said back plate when said drop blade is in said lowered position.

3. The pusher/bucket of claim 2 wherein said first wing has a first wing inner surface, which provides a reference plane for the determination of said separation D with respect to said first wing, and said second wing has a second wing inner surface, which provides a reference plane for the determination of said separation D with respect to said second wing.

4. The pusher/bucket of claim 3 wherein said means for locking said drop blade in said lowered position further comprises:

a first wing tongue extending from said first wing inner surface;

a first drop blade bracket having a first tongue slot configured to accept said first wing tongue, said first drop blade bracket being attached to said drop blade such that, when engaged with said first wing tongue, said substantially planar region of said drop blade is substantially normal to said back plate;

a second wing tongue extending from said second wing inner surface; and a second drop blade bracket having a second tongue slot configured to accept said second wing tongue, said second drop blade bracket being attached to said drop blade and configured such that, when engaged with said second wing tongue, said substantially planar region of said drop blade is substantially normal to said back plate.

5. The pusher/bucket of claim 4 wherein said means for locking said drop blade in said raised position further comprises:

a first plate slot in said back plate configured to accept said first drop blade bracket, a second plate slot in said back plate configured to accept said second drop blade bracket, wherein at least one of said first wing tongue slot and said second tongue slot resides at least in part behind said back plate; and at least one blade retaining pin configured to slidably engage said tongue slot and reside behind said plate.

6. The pusher/bucket of claim 2 wherein said means for locking said drop blade in said lowered position further comprises:

a first wing tongue extending from said first wing inner surface;

a first drop blade bracket having a first tongue slot configured to accept said first wing tongue, said first drop blade bracket being attached to said drop blade such that, when engaged with said first wing tongue, said substantially planar region of said drop blade is substantially normal to said back plate;

a second wing tongue extending from said second wing inner surface; and a second drop blade bracket having a second tongue slot configured to accept said second wing tongue, said second drop blade bracket being attached to said drop blade and configured such that, when engaged with said second wing tongue, said substantially planar region of said drop blade is substantially normal to said back plate.

7. The pusher/bucket of claim 6 wherein said means for locking said drop blade in said raised position further comprises:

a first plate slot in said back plate configured to accept said first drop blade bracket;

a second plate slot in said back plate configured to accept said second drop blade bracket, wherein at least one of said first wing tongue slot and said second tongue slot resides at least in part behind said back plate; and at least one blade retaining pin configured to slidably engage said tongue slot and reside behind said plate.

8. The pusher/bucket of claim 2 wherein said substantially planar lead region has a mounting bar to which said cutting edge attaches.

9. The pusher/bucket of claim 1 further comprising:

a back frame for stiffening said back plate;

a pair of first wing brackets attached to said back frame and extending beyond said back plate;

a first blocking plate positioned between said first wing brackets;

a pair of first wing tabs configured to pivotally engage said pair of first wing brackets;

a pair of first wing pivot pins for providing pivotal action between said back plate and said first wing, said pair of first wing pivot pins being mountable in said pair of first wing brackets and positioned at a distance such that, when said first wing is positioned substantially parallel to said back plate, it is maintained at said separation D therefrom;

a pair of second wing brackets attached to said back frame and extending beyond said back plate;

a second blocking plate positioned between said second wing brackets;

a pair of second wing tabs configured to pivotally engage said pair of second wing brackets; and a pair of second wing pivot pins for providing pivotal action between said back plate and said second wing, said pair of second wing pivot pins being mountable in said pair of second wing brackets and positioned at a distance such that, when said second wing is positioned substantially parallel to said back plate, it is maintained at said separation D therefrom.

10. The pusher/bucket of claim 9 wherein said first blocking plate and said second blocking plate are affixed with respect to said back plate.

11. The pusher/bucket of claim 9 wherein said first blocking plate is affixed with respect to said first wing and said second blocking plate is affixed with respect to said second wing.

12. The pusher/bucket of claim 11 wherein said pair of first wing tabs and said first blocking plate are formed as an integral unit and further wherein said pair of second wing tabs and said second blocking plate are formed as an integral unit.

13. The pusher/bucket of claim 9 wherein said first wing has a first wing inner surface, which provides a reference plane for the determination of said separation D with respect to said first wing, and said second wing has a second wing inner surface, which provides a reference plane for the determination of said separation D with respect to said second wing, and further wherein said means for locking said drop blade in said lowered position further comprises:

a first wing tongue extending from said first wing inner surface;

a first drop blade bracket having a first tongue slot configured to accept said first wing tongue, said first drop blade bracket being attached to said drop blade such that, when engaged with said first wing tongue, said cutting edge is substantially in a plane formed by said first wing scraping edge and said second wing scraping edge;

a second wing tongue extending from said second wing inner surface; and a second drop blade bracket having a second tongue slot configured to accept said second wing tongue, said second drop blade bracket being attached to said drop blade and configured such that, when engaged with said second wing tongue, said cutting edge is substantially in a plane formed by said first wing scraping edge and said second wing scraping edge.

14. The pusher/bucket of claim 13 wherein said means for locking said drop blade in said raised position further comprises:

a first plate slot in said back plate configured to accept said first drop blade bracket;

a second plate slot in said back plate configured to accept said second drop blade bracket, wherein at least one of said first wing tongue slot and said second tongue slot resides at least in part behind said back plate; and at least one blade retaining pin configured to slidably engage said tongue slot and reside behind said plate.

15. The pusher/bucket of claim 1 wherein said means for locking said first wing in designated positions further comprises:

a first wing linear actuator pivotally connected with respect to said back plate and with respect to said first wing; and further wherein said means for locking said second wing in designated positions further comprises:

a second wing linear actuator pivotally connected with respect to said back plate and with respect to said second wing.

16. The pusher/bucket of claim 15 wherein said means for locking said drop blade in said raised position, as well as said means for locking said drop blade in said lowered position, further comprises:

a drop blade linear actuator pivotally connected with respect to said back plate and with respect to said drop blade.

17. The pusher/bucket of claim 1 wherein said means for locking said first wing in designated positions further comprises:

at least one first wing indexing passage in at least one of said first wing brackets; and a first wing positioning pin insertable into said at least one first wing indexing passage; and further wherein said means for locking said second wing in designated positions further comprises:

at least one second wing indexing passage in at least one of said second wing brackets; and a second wing positioning pin insertable into said at least one second wing indexing passage.

18. The pusher/bucket of claim 17 further comprising:

a spring operably connected between said drop blade and said back frame.

19. The pusher/bucket of claim 1 wherein said back scraping plate is mounted to a shoe which is resiliently mounted with respect to said back plate.

20. The pusher/bucket of claim 1 further comprising:

a back frame for stiffening said back plate;

a pair of first wing brackets attached to said back frame and extending beyond said back plate;

a pair of first wing tabs configured to pivotally engage said pair of first wing brackets;

a pair of first wing pivot pins for providing pivotal action between said back plate and said first wing, said pair of first wing pivot pins being mountable in said pair of first wing brackets and positioned at a distance such that, when said first wing is positioned substantially parallel to said back plate, it is maintained at said separation D therefrom;

a pair of second wing brackets attached to said back frame and extending beyond said back plate;

a pair of second wing tabs configured to pivotally engage said pair of second wing brackets; and a pair of second wing pivot pins for providing pivotal action between said back plate and said second wing, said pair of second wing pivot pins being mountable in said pair of second wing brackets and positioned at a distance such that, when said second wing is positioned substantially parallel to said back plate, it is maintained at said separation D therefrom.

* * * * *